US009809783B2

(12) United States Patent
Fossum et al.

(10) Patent No.: US 9,809,783 B2
(45) Date of Patent: Nov. 7, 2017

(54) DETERGENT COMPOSITION COMPRISING AN ACRYLAMIDE/MAPTAC CATIONIC POLYMER

(71) Applicant: The Procter & Gamble Company, Cincinnati, OH (US)

(72) Inventors: Renae Dianna Fossum, Middletown, OH (US); Nicholas David Vetter, Cleves, OH (US); Bernardo M. Aguilera-Mercado, Kenwood, OH (US); Carola Barrera, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/834,464

(22) Filed: Aug. 25, 2015

(65) Prior Publication Data

US 2016/0060573 A1 Mar. 3, 2016

Related U.S. Application Data

(60) Provisional application No. 62/042,366, filed on Aug. 27, 2014.

(51) Int. Cl.

| | |
|---|---|
| ***C11D 1/02*** | (2006.01) |
| ***C11D 1/66*** | (2006.01) |
| ***C11D 1/83*** | (2006.01) |
| ***C11D 1/62*** | (2006.01) |
| ***C11D 9/36*** | (2006.01) |
| ***C11D 3/00*** | (2006.01) |
| ***C11D 3/37*** | (2006.01) |

(52) U.S. Cl.

CPC ..... *C11D 3/001* (2013.01); *C11D 1/83* (2013.01); *C11D 3/373* (2013.01); *C11D 3/3742* (2013.01); *C11D 3/3769* (2013.01); *C11D 3/3773* (2013.01); *C11D 3/3776* (2013.01)

(58) Field of Classification Search

CPC .... C11D 1/02; C11D 1/66; C11D 1/83; C11D 3/162; C11D 1/62; C11D 3/3719; C11D 3/3742; C11D 3/3769; C11D 3/3927; C11D 3/505; C11D 11/0017; C11D 9/36; C11D 17/042

See application file for complete search history.

(56) References Cited

U.S. PATENT DOCUMENTS

| | | | |
|---|---|---|---|
| 5,302,322 | A | 4/1994 | Birtwistle |
| 6,949,498 | B2 | 9/2005 | Murphy et al. |
| 7,202,206 | B2 | 4/2007 | Depoot et al. |
| 7,244,697 | B2 | 7/2007 | Terada |
| 7,273,837 | B2 | 9/2007 | Boutique et al. |
| 7,326,676 | B2 | 2/2008 | Delplancke et al. |
| 7,439,217 | B2 | 10/2008 | Boutique et al. |
| 7,754,671 | B2 | 7/2010 | Lin et al. |
| 7,772,175 | B2 | 8/2010 | Panandiker et al. |
| 7,829,514 | B2 | 11/2010 | Paul et al. |
| 7,994,112 | B2 | 8/2011 | Vanpachtenbeke et al. |
| 8,207,105 | B2 | 6/2012 | Panandiker et al. |
| 8,263,544 | B2 | 9/2012 | Panandiker et al. |
| 8,450,263 | B2 | 5/2013 | Panandiker et al. |
| 8,541,352 | B2 | 9/2013 | Randall et al. |
| 8,546,314 | B2 | 10/2013 | Randall et al. |
| 8,633,146 | B2 | 1/2014 | Wang et al. |
| 8,765,659 | B2 | 7/2014 | Gizaw et al. |
| 9,186,642 | B2 | 11/2015 | Dihora et al. |
| 2008/0118568 | A1 | 5/2008 | Smets et al. |
| 2008/0229519 | A1* | 9/2008 | Depoot ..... C11D 3/227 8/401 |
| 2008/0234165 | A1 | 9/2008 | Panandiker et al. |
| 2008/0242584 | A1 | 10/2008 | Wahl et al. |
| 2011/0177994 | A1 | 7/2011 | Wahl et al. |
| 2012/0083438 | A1* | 4/2012 | Panandiker ..... C11D 1/02 510/332 |
| 2012/0137448 | A1 | 6/2012 | Panandiker et al. |
| 2013/0118531 | A1 | 5/2013 | Dobrawa et al. |
| 2014/0020188 | A1 | 1/2014 | Gizaw et al. |
| 2014/0030205 | A1 | 1/2014 | Panandiker et al. |
| 2014/0037703 | A1* | 2/2014 | Dihora ..... A61K 8/11 424/401 |
| 2014/0094397 | A1* | 4/2014 | Guida ..... C11D 17/0013 510/342 |
| 2014/0227328 | A1 | 8/2014 | Dihora et al. |
| 2014/0296127 | A1 | 10/2014 | Hulskotter et al. |
| 2015/0030643 | A1 | 1/2015 | Gartstein et al. |
| 2015/0030644 | A1 | 1/2015 | Oh et al. |
| 2015/0071977 | A1 | 3/2015 | Dihora et al. |

FOREIGN PATENT DOCUMENTS

| | | |
|---|---|---|
| WO | WO 2005/087907 A1 | 9/2005 |
| WO | WO 2009/095823 A1 | 8/2009 |
| WO | WO 2010/025097 A1 | 3/2010 |
| WO | WO 2012/075611 A1 | 6/2012 |

OTHER PUBLICATIONS

U.S. Appl. No. 14/834,459, filed Aug. 25, 2015, Rajan Keshav Panandiker.

U.S. Appl. No. 14/834,460, filed Aug. 25, 2015, Rajan Keshav Panandiker.

U.S. Appl. No. 14/834,463, filed Aug. 25, 2015, Rajan Keshav Panandiker.

U.S. Appl. No. 14/834,466, filed Aug. 25, 2015, Rajan Keshav Panandiker.

U.S. Appl. No. 14/834,468, filed Aug. 25, 2015, Rajan Keshav Panandiker.

U.S. Appl. No. 14/864,921, filed Sep. 25, 2015, Renae Dianna Fossum.

International Search Report for International Application No. PCT/US2015/046630, dated Nov. 6, 2015, containing 10 pages.

* cited by examiner

*Primary Examiner* — Charles Boyer

(74) *Attorney, Agent, or Firm* — Gregory S. Darley-Emerson; Leonard W. Lewis; Steven W. Miller

(57) ABSTRACT

Fabric care compositions comprising a cationic polymer, a silicone, and a surfactant system. Methods of making and using such compositions.

15 Claims, No Drawings

DETERGENT COMPOSITION COMPRISING AN ACRYLAMIDE/MAPTAC CATIONIC POLYMER

FIELD OF THE INVENTION

The present disclosure relates to fabric care compositions comprising a cationic polymer, a silicone, and a surfactant system. The present disclosure further relates to methods of making and using such compositions.

BACKGROUND OF THE INVENTION

Consumers typically desire their clothes to feel soft after they have been washed. To meet this need, detergent manufacturers may add silicone, a known "feel benefit" active, to detergent compositions. Typically, when fabrics are washed in such compositions, at least some of the silicone deposits on the target fabric. Higher levels of silicone deposition generally correlate with improved softness benefits.

However, when fabrics are washed with a detergent composition that comprises silicone, some of the silicone in the wash liquor may not deposit on the washed fabric and instead goes down the drain with the excess water, thereby wasting the silicone. This problem is particularly acute in conventional detergents that comprise silicone. Without intending to be bound by theory, it is believed that the surfactant in the detergent contributes to the decreased silicone deposition efficiency.

Detergent manufacturers may attempt to improve the deposition efficiency of silicone by formulating the detergents with cationic deposition polymers, which facilitate the deposition of silicone onto the target fabric. However, even with the use of a cationic deposition polymer, a meaningful amount of silicone fails to deposit on the target fabric.

In view of the above, there is a need to improve silicone deposition efficiency in detergent compositions that comprise surfactant. It has surprisingly been found that by carefully selecting the ratios of surfactants in a detergent composition that also comprises certain cationic deposition polymers, silicone deposition is improved.

SUMMARY OF THE INVENTION

The present disclosure relates to a composition comprising acationic polymer, a silicone, and a surfactant system.

In some aspects, the present disclosure relates to a laundry detergent composition comprising a non-polysaccharide cationic polymer, a silicone, and a surfactant system, where the non-polysaccharide cationic polymer is characterized by having a calculated cationic charge density of from about 1 meq/g to about 12 meq/g, where the cationic polymer is further characterized by a molecular weight of from about 200 kDaltons to about 5,000 kDaltons; and where the surfactant system comprises anionic surfactant and nonionic surfactant in a ratio of from about 1.1:1 to about 2.5:1.

In some aspects, the present disclosure relates to methods of treating fabrics with the compositions disclosed herein.

DETAILED DESCRIPTION OF THE INVENTION

The present disclosure relates to fabric treatment compositions comprising a cationic polymer, a silicone, and a surfactant system. The fabric care compositions of the present disclosure are intended to be stand-alone products that deliver both cleaning and/or whiteness benefits as well as feel and/or silicone deposition benefits. These benefits are provided by selecting particular low-molecular-weight cationic deposition polymers and particular surfactant systems for use in silicone-comprising compositions. Each of these elements is discussed in more detail below.

Definitions

As used herein, the term "molecular weight" refers to the weight average molecular weight of the polymer chains in a polymer composition. Further, as used herein, the "weight average molecular weight" ("Mw") is calculated using the equation:

$$Mw=(\Sigma i\ Ni\ Mi^2)/(\Sigma i\ Ni\ Mi)$$

where Ni is the number of molecules having a molecular weight Mi. The weight average molecular weight must be measured by the method described in the Test Methods section.

As used herein "mol %" refers to the relative molar percentage of a particular monomeric structural unit in a polymer. It is understood that within the meaning of the present disclosure, the relative molar percentages of all monomeric structural units that are present in the cationic polymer add up to 100 mol %.

As used herein, the term "derived from" refers to monomeric structural unit in a polymer that can be made from a compound or any derivative of such compound, i.e., with one or more substituents. Preferably, such structural unit is made directly from the compound in issue. For example, the term "structural unit derived from (meth)acrylamide" refers to monomeric structural unit in a polymer that can be made from (meth)acrylamide, or any derivative thereof with one or more substituents. Preferably, such structural unit is made directly from (meth)acrylamide. As used herein, the term "(meth)acrylamide" refers to either acrylamide ("Aam") or methacrylamide; (meth)acrylamide is abbreviated herein as "(M)AAm." For another example, the term "structural unit derived from a diallyl dimethyl ammonium salt" refers to monomeric structural unit in a polymer that can be made directly from a diallyl dimethyl ammonium salt (DADMAS), or any derivative thereof with one or more substituents. Preferably, such structural unit is made directly from such diallyl dimethyl ammonium salt. For yet another example, the term "structural unit derived from acrylic acid" refers to monomeric structural unit in a polymer that can be made from acrylic acid (AA), or any derivative thereof with one or more substituents. Preferably, such structural unit is made directly from acrylic acid.

The term "ammonium salt" or "ammonium salts" as used herein refers to various compounds selected from the group consisting of ammonium chloride, ammonium fluoride, ammonium bromide, ammonium iodine, ammonium bisulfate, ammonium alkyl sulfate, ammonium dihydrogen phosphate, ammonium hydrogen alkyl phosphate, ammonium dialkyl phosphate, and the like. For example, the diallyl dimethyl ammonium salts as described herein include, but are not limited to: diallyl dimethyl ammonium chloride (DADMAC), diallyl dimethyl ammonium fluoride, diallyl dimethyl ammonium bromide, diallyl dimethyl ammonium iodine, diallyl dimethyl ammonium bisulfate, diallyl dimethyl ammonium alkyl sulfate, diallyl dimethyl ammonium dihydrogen phosphate, diallyl dimethyl ammonium hydrogen alkyl phosphate, diallyl dimethyl ammonium dialkyl phosphate, and combinations thereof. Preferably but not necessarily, the ammonium salt is ammonium chloride.

As used herein, articles such as "a" and "an" when used in a claim, are understood to mean one or more of what is claimed or described.

As used herein, the terms "comprising," "comprises," "include", "includes" and "including" are meant to be non-limiting. The term "consisting of" or "consisting essentially of" are meant to be limiting, i.e., excluding any components or ingredients that are not specifically listed except when they are present as impurities. The term "substantially free of" as used herein refers to either the complete absence of an ingredient or a minimal amount thereof merely as impurity or unintended byproduct of another ingredient. In some aspects, a composition that is "substantially free" of a component means that the composition comprises less than 0.1%, or less than 0.01%, or even 0%, by weight of the composition, of the component.

As used herein, the term "solid" includes granular, powder, bar, bead, and tablet product forms.

As used herein, the term "fluid" includes liquid, gel, paste, and gas product forms.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$.

As used herein, the term "cationic polymer" means a polymer having a net cationic charge. Furthermore, it is understood that the cationic polymers described herein are typically synthesized according to known methods from polymer-forming monomers (e.g., (meth)acrylamide monomers, DADMAS monomers, etc.). As used herein, the resulting polymer is considered the "polymerized portion" of the cationic polymer. However, after the synthesis reaction is complete, a portion of the polymer-forming monomers may remain unreacted and/or may form oligomers. As used herein, the unreacted monomers and oligomers are considered the "unpolymerized portion" of the cationic polymer. As used herein, the term "cationic polymer" includes both the polymerized portion and the unpolymerized portion unless stated otherwise. In some aspects the cationic polymer, comprises an unpolymerized portion of the cationic polymer. In some aspects, the cationic polymer comprises less than about 50%, or less than about 35%, or less than about 20%, or less than about 15%, or less than about 10%, or less than about 5%, or less than about 2%, by weight of the cationic polymer, of an unpolymerized portion. The unpolymerized portion may comprise polymer-forming monomers, cationic polymer-forming monomers, or DADMAC monomers, and/or oligomers thereof. In some aspects, the cationic polymer comprises more than about 50%, or more than about 65%, or more than about 80%, or more than about 85%, or more than about 90%, or more than about 95%, or more than about 98%, by weight of the cationic polymer, of a polymerized portion. Furthermore, it is understood that the polymer-forming monomers, once polymerized, may be modified to form polymerized repeat/structural units. For example, polymerized vinyl acetate may be hydrolyzed to form vinyl alcohol.

As used herein, "charge density" refers to the net charge density of the polymer itself and may be different from the monomer feedstock. Charge density for a homopolymer may be calculated by dividing the number of net charges per repeating (structural) unit by the molecular weight of the repeating unit. The positive charges may be located on the backbone of the polymers and/or the side chains of polymers. For some polymers, for example those with amine structural units, the charge density depends on the pH of the carrier. For these polymers, charge density is calculated based on the charge of the monomer at pH of 7. "CCD" refers to cationic charge density, and "ACD" refers to anionic charge density. Typically, the charge is determined with respect to the polymerized structural unit, not necessarily the parent monomer.

As used herein, the term "Cationic Charge Density" (CCD) means the amount of net positive charge present per gram of the polymer. Cationic charge density (in units of equivalents of charge per gram of polymer) may be calculated according to the following equation:

$$CCD = \frac{(Qc \times \text{mol \% } c) - (Qa \times \text{mol \% } a)}{(\text{mol \% } c \times MWc) + \text{mol \% } n \times MWn) + (\text{mol \% } a \times MWa)}$$

where: Qc, Qn, and Qa are the molar equivalents of charge of the cationic, nonionic, and anionic repeat units (if any), respectively; Mol % c, mol % n, and mol % a are the molar ratios of the cationic, nonionic, and anionic repeat units (if any), respectively; and MWc, MWn, and MWa are the molecular weights of the cationic, nonionic, and anionic repeat units (if any), respectively. To convert equivalents of charge per gram to milliequivalents of charge per gram (meq/g), multiply equivalents by 1000. If a polymer comprises multiple types of cationic repeat units, multiple types of nonionic repeat units, and/or multiple types of anionic repeat units, one of ordinary skill can adjust the equation accordingly.

By way of example, a cationic homopolymer (molar ratio=100% or 1.00) with a monomer molecular weight of 161.67 g/mol, the CCD is calculated as follows: polymer charge density is (1)×(1.00)/(161.67)×1000=6.19 meq/g. A copolymer with a cationic monomer with a molecular weight of 161.67 and a neutral co-monomer with a molecular weight of 71.079 in a mol ratio of 1:1 is calculated as (1×0.50/[(0.50×161.67)+(0.50×71.079)]*1000=4.3 meq/g. A terpolymer with a cationic monomer with a molecular weight of 161.67, a neutral co-monomer with a molecular weight of 71.079, and an anionic co-monomer with a neutralized molecular weight of 94.04 g/mol in a mol ratio of 80.8:15.4:3.8 has a cationic charge density of 5.3 meq/g.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It is understood that the test methods that are disclosed in the Test Methods Section of the present application must be used to determine the respective values of the parameters of the compositions and methods described and claimed herein.

Fabric Care Composition

The present disclosure relates to fabric care compositions. As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. Preferably, the present compositions are used as a pre-laundering treatment or during the wash cycle. The cleaning compositions may have a form selected from liquid, powder, single-phase or multi-phase unit dose, pouch, tablet, gel, paste, bar, or flake.

The detergent composition is preferably a liquid laundry detergent. The liquid laundry detergent composition preferably has a viscosity from about 1 to about 2000 centipoise (1-2000 mPa·s), or from about 200 to about 800 centipoise (200-800 mPa·s). The viscosity is determined using a Brookfield viscometer, No. 2 spindle, at 60 RPM/s, measured at 25° C.

In one embodiment, the laundry detergent composition is a solid laundry detergent composition, and preferably a free-flowing particulate laundry detergent composition (i.e., a granular detergent product).

In some aspects, the fabric care composition is in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the composition is contained in at least one of the compartments. The compartments may be arranged in superposed orientation, i.e., one positioned on top of the other, where they may share a common wall. In one aspect, at least one compartment is superposed on another compartment. Alternatively, the compartments may be positioned in a side-by-side orientation, i.e., one orientated next to the other. The compartments may even be orientated in a 'tire and rim' arrangement, i.e., a first compartment is positioned next to a second compartment, but the first compartment at least partially surrounds the second compartment, but does not completely enclose the second compartment. Alternatively, one compartment may be completely enclosed within another compartment.

In some aspects, the unit dose form comprises water-soluble film that forms the compartment and encapsulates the detergent composition. Preferred film materials are preferably polymeric materials; for example, the water-soluble film may comprise polyvinyl alcohol. The film material can, for example, be obtained by casting, blow-moulding, extrusion, or blown extrusion of the polymeric material, as known in the art. Suitable films are those supplied by Monosol (Merrillville, Ind., USA) under the trade references M8630, M8900, M8779, and M8310, films described in U.S. Pat. No. 6,166,117, U.S. Pat. No. 6,787,512, and US2011/0188784, and PVA films of corresponding solubility and deformability characteristics.

When the fabric care composition is a liquid, the fabric care composition typically comprises water. The composition may comprise from about 1% to about 80%, by weight of the composition, water. When the composition is a liquid composition, for example a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. In some aspects, the composition comprises from about 1% to 20%, or from about 3% to about 15%, or from about 5% to about 12%, by weight of the composition, water.

Cationic Polymer

The detergent compositions of the present disclosure comprise a cationic polymer. Certain cationic polymers can be used in detergent compositions to provide feel benefits or to facilitate deposition of other feel actives, such as silicone. The cationic polymers described herein, in combination with particular surfactant systems, provide improved silicone deposition.

In some aspects, the cationic polymers described herein are characterized by a calculated cationic charge density of from about 1 meq/g, or from about 1.2 meq/g, or from about 1.5 meq/g, or from about 1.9 meq/g, to about 12 meq/g, or to about 8 meq/g, or to about 6 meq/g, or to about 5 meq/g, or to about 4 meq/g, or to about 3 meq/g, or to about 2.5 meq/g or to about 2 meq/g. In some aspects, the cationic polymers described herein are characterized by a cationic charge density of from about 1 meq/g to about 6 meq/g, or to about 5 meq/g, or to about 4 meq/g, or even to about 2.5 meq/g.

The cationic polymers described herein have a weight average molecular weight of from about 200 kDaltons to about 5000 kDaltons, preferably from about 500 kDaltons to about 5000 kDaltons, more preferably from about 600 kDaltons to about 5000 kDaltons, more preferably from about 800 kDaltons to about 2000 kDaltons.

The detergent compositions typically comprise from about 0.01% to about 2%, or to about 1.5%, or to about 1%, or to about 0.75%, or to about 0.5%, or to about 0.3%, or from about 0.05% to about 0.25%, by weight of the detergent composition, of cationic polymer.

In some aspects, the cationic polymers described herein are substantially free of, or free of, any silicone-derived structural unit. It is understood that such a limitation does not preclude the detergent composition itself from containing silicone, nor does it preclude the cationic polymers described herein from complexing with silicone comprised in such detergent compositions or in a wash liquor.

The compositions of the present disclosure may be substantially free of polysaccharide-based cationic polymers, such as cationic hydroxyethylene cellulose, particularly when the compositions comprise enzymes such as amylase, lipase, and/or protease. Such polysaccharide-based polymers are typically susceptible to degradation by cellulase enzymes, which are often present at trace levels in commercially-supplied enzymes. Thus, compositions comprising polysaccharide-based cationic polymers are typically incompatible with enzymes in general, even when cellulase is not intentionally added. Thus, in some aspects, the compositions of the present case are non-polysaccharide-based cationic polymers.

In some aspects, the cationic polymer is comprised of structural units. The structural units may be nonionic, cationic, anionic, or mixtures thereof. The polymers described herein may comprise non-cationic structural units, but the polymers are still characterized by having a net cationic charge.

In some aspects, the cationic polymer consists of only one type of structural unit, i.e., the polymer is a homopolymer. In some aspects, the cationic polymer consists of two types of structural units, i.e., the polymer is a copolymer. In some aspects, the cationic polymer consists of three types of structural units, i.e., the polymer is a terpolymer. In some aspects, the cationic polymer comprises two or more types of structural units. The structural units may be described as first structural units, second structural units, third structural units, etc. The structural units, or monomers, can be incorporated in the cationic polymer in a random format or in a blocky format.

In some aspects, the cationic polymer comprises a nonionic structural unit. In some aspects, the cationic polymer comprises from about 5 mol % to about 98 mol %, or from about 10 mol % to about 95 mol %, or from about 15 mol % to about 90 mol %, of a nonionic structural unit. In some aspects, the cationic polymer comprises a nonionic structural unit derived from a monomer selected from the group consisting of (meth)acrylamide, N,N-dialkyl acrylamide, N,N-dialkylmethacrylamide, $C_1$-$C_{12}$ alkyl acrylate, $C_1$-$C_{12}$ hydroxyalkyl acrylate, polyalkylene glycol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

In some aspects, the cationic polymer comprises a cationic structural unit. In some aspects, the cationic polymer comprises from about 2 mol % to about 100 mol %, or from about 5 mol % to about 95 mol %, or from about 10 mol % to about 90 mol %, or from about 15 mol % to about 85 mol %, or from about 20 mol % to about 80 mol %, or from about 25 mol % to about 75 mol %, of a cationic structural unit.

In some aspects, the cationic polymer comprises a cationic structural unit derived from a cationic monomer. In some aspects, the cationic monomer is selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, methacrylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof.

Preferably, the cationic monomer is selected from the group consisting of diallyl dimethyl ammonium salts (DADMAS), N,N-dimethyl aminoethyl acrylate, N,N-dimethyl aminoethyl methacrylate (DMAM), [2-(methacryloylamino)ethyl]tri-methylammonium salts, N,N-dimethylaminopropyl acrylamide (DMAPA), N,N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof.

Even more preferably, the cationic polymer comprises a cationic monomer derived from from diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof. Typically, DADMAS, APTAS, and MAPTAS are salts comprising chloride (i.e., DADMAC, APTAC, and/or MAPTAC).

In some aspects, the cationic polymer comprises an anionic structural unit. The cationic polymer may comprise from about 0.01 mol % to about 15 mol %, or from about 0.1 mol % to about 10 mol %, or from about 1 mol % to about 5 mol %, or from about 1.5 mol % to about 4 mol % of an anionic structural unit. In some aspects, the polymer comprises 0 mol % of an anionic structural unit, i.e., is substantially free of an anionic structural unit. In some aspects, the anionic structural unit is derived from an anionic monomer selected from the group consisting of acrylic acid (AA), methacrylic acid, maleic acid, vinyl sulfonic acid, styrene sulfonic acid, acrylamidopropylmethane sulfonic acid (AMPS) and their salts, and mixtures thereof.

In some aspects, the cationic polymer is selected from acrylamide/DADMAS, acrylamide/DADMAS/acrylic acid, acrylamide/APTAS, acrylamide/MAPTAS, acrylamide/QVi, polyvinyl formamide/DADMAS, poly(DADMAS), acrylamide/MAPTAS/acrylic acid, acrylamide/APTAS/acrylic acid, and mixtures thereof. Preferably, the cationic polymer is acrylamide/MAPTAS, more preferably acrylamide/MAPTAC.

In a particularly preferred embodiment, the cationic polymer is an acrylamide/MAPTAC polymer with a calculated cationic charge density of from about 1 meq/g to about 2 meq/g and a weight average molecular weight of from about 800 kDaltons to about 2000 kDaltons.

The cationic polymer may include a cationic polysaccharide. Cationic polysaccharides include cationic cellulose derivatives, cationic guar gum derivatives, chitosan and derivatives, and cationic starches. Suitable cationic polysaccharides include cationically modified cellulose, particularly cationic hydroxyethylcellulose and cationic hydroxypropylcellulose. Preferred cationic celluloses for use herein include those which may or may not be hydrophobically-modified, including those having hydrophobic substituent groups, having a molecular weight of from 50,000 to 2,000,000, more preferably from 100,000 to 1,000,000, and most preferably from 200,000 to 800,000. These cationic materials have repeating substituted anhydroglucose units that correspond to the general Structural Formula I as follows:

Structural Formula I

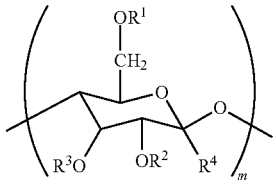

wherein:

a. m is an integer from 20 to 10,000 b. Each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

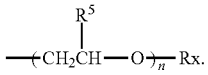

Preferably, $R^1$, $R^2$, $R^3$ are each independently selected from the group consisting of: H; and $C_1$-$C_4$ alkyl;

wherein:

n is an integer selected from 0 to 10 and

Rx is selected from the group consisting of: $R_5$;

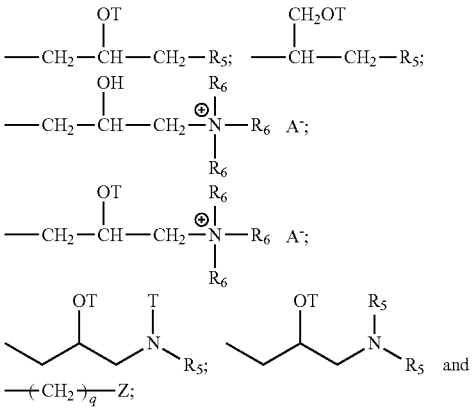

wherein at least one Rx in said polysaccharide has a structure selected from the group consisting of:

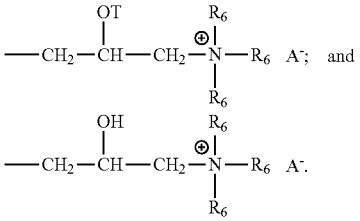

wherein $A^-$ is a suitable anion. Preferably, $A^-$ is selected from the group consisting of: $Cl^-$, $Br^-$, $I^-$, methylsulfate, ethylsulfate, toluene sulfonate, carboxylate, and phosphate;

Z is selected from the group consisting of carboxylate, phosphate, phosphonate, and sulfate.

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH. Preferably, each $R_5$ is selected from the group consisting of: H, $C_1$-$C_{32}$ alkyl, and $C_1$-$C_{32}$ substituted alkyl. More preferably, $R_5$ is selected from the group consisting of H, methyl, and ethyl.

Each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl. Preferably, each $R_6$ is selected from the group consisting of: H, $C_1$-$C_{32}$ alkyl, and $C_1$-$C_{32}$ substituted alkyl.

Each T is independently selected from the group: H,

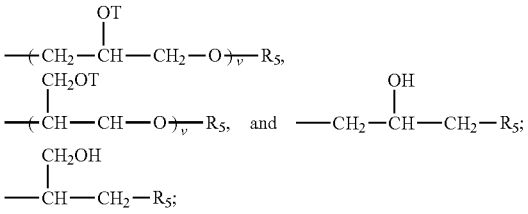

wherein each v in said polysaccharide is an integer from 1 to 10. Preferably, v is an integer from 1 to 5. The sum of all v indices in each Rx in said polysaccharide is an integer from 1 to 30, more preferably from 1 to 20, even more preferably from 1 to 10. In the last

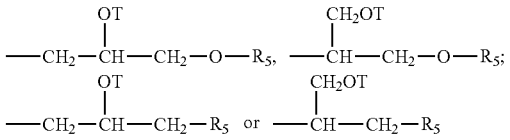

group in a chain, T is always an H.

Alkyl substitution on the anhydroglucose rings of the polymer may range from 0.01% to 5% per glucose unit, more preferably from 0.05% to 2% per glucose unit, of the polymeric material.

The cationic cellulose may be lightly cross-linked with a dialdehyde, such as glyoxyl, to prevent forming lumps, nodules or other agglomerations when added to water at ambient temperatures.

The cationic cellulose ethers of Structural Formula I likewise include those which are commercially available and further include materials which can be prepared by conventional chemical modification of commercially available materials. Commercially available cellulose ethers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33-col. 4, line 67. Suitable cationic galactomannans include cationic guar gums or cationic locust bean gum. An example of a cationic guar gum is a quaternary ammonium derivative of Hydroxypropyl Guar such as those sold under the trade name: Jaguar C13 and Jaguar Excel available from Rhodia, Inc of Cranbury N.J. and N-Hance by Aqualon, Wilmington, Del.

Silicone

The present fabric care compositions may comprise silicone, which is a benefit agent known to provide feel and/or color benefits to fabrics. Applicants have surprisingly found that compositions comprising silicone, cationic polymer, and surfactant systems according to the present disclosure provide improved softness and/or whiteness benefits.

The fabric care composition may comprise from about 0.1% to about 30%, or from about 0.1% to about 15%, or from about 0.2% to about 12%, or from about 0.5% to about 10%, or from about 0.7% to about 9%, or from about 1% to about 5%, by weight of the composition, of silicone.

The silicone may be a polysiloxane, which is a polymer comprising Si—O moieties. The silicone may be a silicone that comprises functionalized siloxane moieties. Suitable silicones may comprise Si—O moieties and may be selected from (a) non-functionalized siloxane polymers, (b) functionalized siloxane polymers, and combinations thereof. The functionalized siloxane polymer may comprise an aminosilicone, silicone polyether, polydimethyl siloxane (PDMS), cationic silicones, silicone polyurethane, silicone polyureas, or mixtures thereof. The silicone may comprise a cyclic silicone. The cyclic silicone may comprise a cyclomethicone of the formula $[(CH_3)_2SiO]_n$ where n is an integer that may range from about 3 to about 7, or from about 5 to about 6.

The molecular weight of the silicone is usually indicated by the reference to the viscosity of the material. The silicones may comprise a viscosity of from about 10 to about 2,000,000 centistokes at 25° C. Suitable silicones may have a viscosity of from about 10 to about 800,000 centistokes, or from about 100 to about 200,000 centistokes, or from about 1000 to about 100,000 centistokes, or from about 2000 to about 50,000 centistokes, or from about 2500 to about 10,000 centistokes, at 25° C.

Suitable silicones may be linear, branched or cross-linked. The silicones may comprise silicone resins. Silicone resins are highly cross-linked polymeric siloxane systems. The cross-linking is introduced through the incorporation of trifunctional and tetrafunctional silanes with monofunctional or difunctional, or both, silanes during manufacture of the silicone resin. As used herein, the nomenclature SiO"n"/2 represents the ratio of oxygen to silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

The silicone may comprise a non-functionalized siloxane polymer. The non-functionalized siloxane polymer may comprise polyalkyl and/or phenyl silicone fluids, resins and/or gums. The non-functionalized siloxane polymer may have Formula (I) below:

$$[R_1R_2R_3SiO_{1/2}]_n[R_4R_4SiO_{2/2}]_m[R_4SiO_{3/2}]_j \quad \text{Formula (I)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from 0 to about 10, or from 0 to about 4, or 0.

$R_2$, $R_3$ and $R_4$ may comprise methyl, ethyl, propyl, $C_4$-$C_{20}$ alkyl, and/or $C_6$-$C_{20}$ aryl moieties. Each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

The silicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

The functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning® Corporation, and various Silwet® surfactants available from Momentive Silicones.

The silicone may be chosen from a random or blocky silicone polymer having the following Formula (II) below:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j \quad \text{Formula (II)}$$

wherein:

j is an integer from 0 to about 98; in one aspect j is an integer from 0 to about 48; in one aspect, j is 0;

k is an integer from 0 to about 200, in one aspect k is an integer from 0 to about 50, or from about 2 to about 20; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of $—(CH_2)_s—$ wherein s is an integer from about 2 to about 8, from about 2 to about 4; in one aspect, each X in said alkyl siloxane polymer comprises a substituted divalent alkylene radical selected from the group consisting of: $—CH_2—CH(OH)—CH_2—$; $—CH_2—CH_2—CH(OH)—$; and

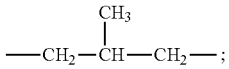

each Z is selected independently from the group consisting of

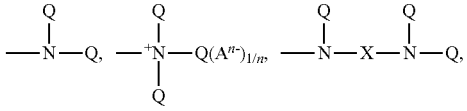

-continued

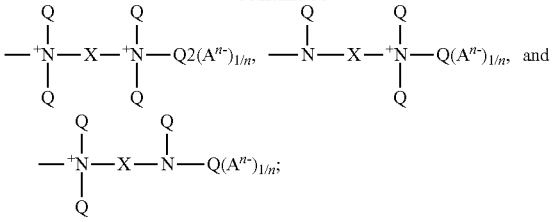

with the proviso that when Z is a quat, Q cannot be an amide, imine, or urea moiety;

for $ZA^{n-}$ is a suitable charge balancing anion; for example, $A^{n-}$ may be selected from the group consisting of $Cl^-$, $Br^-$, $I^-$, methylsulfate, toluene sulfonate, carboxylate and phosphate; and at least one Q in said silicone is independently selected from H; —$CH_2$—CH(OH)—$CH_2$—$R_5$;

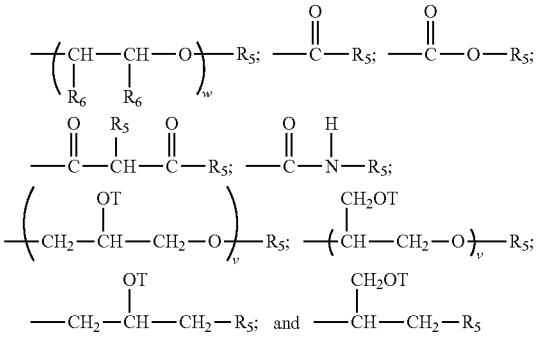

each additional Q in said silicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

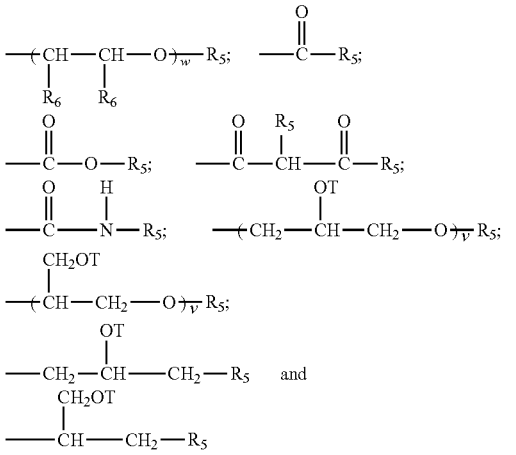

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6$—$CHR_6$—O—$)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

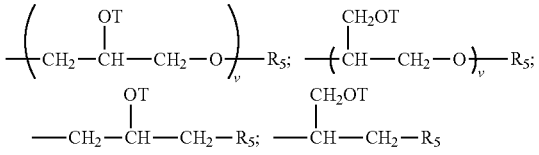

and wherein each v in said silicone is an integer from 1 to about 10, in one aspect, v is an integer from 1 to about 5 and the sum of all v indices in each Q in the silicone is an integer from 1 to about 30 or from 1 to about 20 or even from 1 to about 10.

$R_1$ may comprise —OH.

The functionalized siloxane polymer may comprise an aminosilicone. The aminosilicone may comprise a functional group. The functional group may comprise a monoamine, a diamine, or mixtures thereof. The functional group may comprise a primary amine, a secondary amine, a tertiary amine, quaternized amines, or combinations thereof. The functional group may comprise primary amine, a secondary amine, or combinations thereof.

For example, the functionalized siloxane polymer may comprise an aminosilicone having a formula according to Formula II (above), where: j is 0; k is an integer from 1 to about 10; m is an integer from 150 to about 1000, or from about 325 to about 750, or from about 400 to about 600; each $R_1$, $R_2$ and $R_3$ is selected independently from $C_1$-$C_{32}$ alkoxy and $C_1$-$C_{32}$ alkyl; each $R_4$ is $C_1$-$C_{32}$ alkyl; each X is selected from the group consisting of —$(CH_2)_s$— wherein s is an integer from about 2 to about 8, or from about 2 to about 4; and each Z is selected independently from the group consisting of

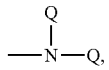

where each Q in the silicone is selected from the group comprising of H.

The functionalized siloxane polymer may comprise an aminosilicone having a formula according to Formula II (above), where: j is 0; k is an integer from 1 to about 10; m is an integer from 150 to about 1000, or from about 325 to about 750, or from about 400 to about 600; each $R_1$, $R_2$ and $R_3$ is selected independently from $C_1$-$C_{32}$ alkoxy and $C_1$-$C_{32}$ alkyl; each $R_4$ is $C_1$-$C_{32}$ alkyl; each X is selected from the group consisting of —$(CH_2)_s$— wherein s is an integer from about 2 to about 8, or from about 2 to about 4; and each Z is selected independently from the group consisting of

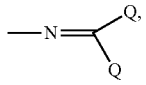

where each Q in the silicone is independently selected from the group consisting of H, C1-C32 alkyl, C1-C32 substituted alkyl, C6-C32 aryl, C5-C32 substituted aryl, C6-C32 alkylaryl, and C5-C32 substituted alkylaryl; with the proviso that both Q cannot be H atoms.

Other suitable aminosilicones are described in U.S. Pat. Nos. 7,335,630 B2 and 4,911,852, and USPA 2005/0170994A1. The aminosilicone may be that described in U.S. Patent Application 61/221,632.

Exemplary commercially available aminosilicones include: DC 8822, 2-8177, and DC-949, available from Dow Corning® Corporation; KF-873, available from Shin-Etsu Silicones, Akron, Ohio; and Magnasoft Plus, available from Momentive (Columbus, Ohio, USA).

The functionalized siloxane polymer may comprise silicone-urethanes, such as those described in U.S. Patent Application 61/170,150. These are commercially available from Wacker Silicones under the trade name SLM-21200®.

Other modified silicones or silicone copolymers may also be useful herein. Examples of these include silicone-based quaternary ammonium compounds (Kennan quats) disclosed in U.S. Pat. Nos. 6,607,717 and 6,482,969; end-terminal quaternary siloxanes; silicone aminopolyalkylene-oxide block copolymers disclosed in U.S. Pat. Nos. 5,807,956 and 5,981,681; hydrophilic silicone emulsions disclosed in U.S. Pat. No. 6,207,782; and polymers made up of one or more crosslinked rake or comb silicone copolymer segments disclosed in U.S. Pat. No. 7,465,439. Additional modified silicones or silicone copolymers useful herein are described in US Patent Application Nos. 2007/0286837A1 and 2005/0048549A1.

The above-noted silicone-based quaternary ammonium compounds may be combined with the silicone polymers described in U.S. Pat. Nos. 7,041,767 and 7,217,777 and US Application number 2007/0041929A1.

The silicone may comprise amine ABn silicones and quat ABn silicones. Such silicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones).

The silicone comprising amine ABn silicones and/or quat ABn silicones may have the following structure of Formula (III):

$$D_z\text{-}(E\text{-}B)_x\text{-}A\text{-}(B\text{-}E)_x\text{-}D_z \qquad \text{Formula (III)}$$

wherein:

each index x is independently an integer from 1 to 20, from 1 to 12, from 1 to 8, or from 2 to 6, and each z is independently 0 or 1;

A has the following structure:

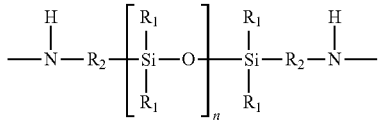

wherein:

each $R_1$ is independently a H, —OH, or $C_1$-$C_{22}$ alkyl group, in one aspect H, —OH, or $C_1$-$C_{12}$ alkyl group, H, —OH, or $C_1$-$C_2$ alkyl group, or —$CH_3$;

each $R_2$ is independently selected from a divalent $C_1$-$C_{22}$ alkylene radical, a divalent $C_2$-$C_{12}$ alkylene radical, a divalent linear $C_2$-$C_8$ alkylene radical, or a divalent linear $C_3$-$C_4$ alkylene radical;

the index n is an integer from 1 to about 5,000, from about 10 to about 1,000, from about 25 to about 700, from about 100 to about 500, or from about 450 to about 500;

each B is independently selected from the following moieties:

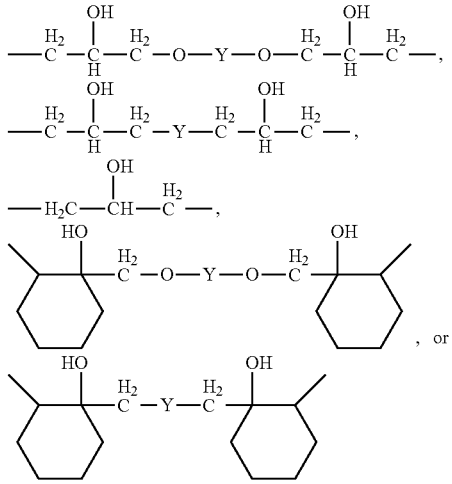

wherein for each structure, Y is a divalent $C_2$-$C_{22}$ alkylene radical that is optionally interrupted by one or more heteroatoms selected from the group consisting of O, P, S, N and combinations thereof or a divalent $C_8$-$C_{22}$ aryl alkylene radical, in one aspect a divalent $C_2$-$C_8$ alkylene radical that is optionally interrupted by one or more heteroatoms selected from the group consisting of O, P, S, N and combinations thereof or a divalent $C_8$-$C_{16}$ aryl alkylene radical, in one aspect a divalent $C_2$-$C_6$ alkylene radical that is optionally interrupted by one or more heteroatoms selected from the group consisting of O, N and combinations thereof or a divalent $C_8$-$C_{12}$ aryl alkylene radical;

each E is independently selected from the following moieties:

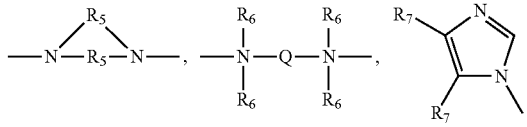

wherein:

each $R_5$ and each Q is independently selected from a divalent $C_1$-$C_{12}$ linear or branched aliphatic hydrocarbon radical that is optionally interrupted by one or more heteroatoms selected from the group consisting of O, P, S, N and combinations thereof, in one aspect a divalent $C_1$-$C_8$ linear or branched aliphatic hydrocarbon radical that is optionally interrupted by one or more heteroatoms selected from the group consisting of O, P, S, N and combinations thereof, in one aspect a divalent $C_1$-$C_3$ linear or branched aliphatic hydrocarbon radical that is optionally interrupted by one or more heteroatoms selected from the group consisting of O, N and combinations thereof;

each $R_6$ and $R_7$ is independently selected from H, $C_1$-$C_{20}$ alkyl, $C_1$-$C_{20}$ substituted alkyl, $C_6$-$C_{20}$ aryl, and $C_6$-$C_{20}$ substituted aryl, in one aspect H, $C_1$-$C_{12}$ alkyl, $C_1$-$C_{12}$ substituted alkyl, $C_6$-$C_{12}$ aryl, and $C_6$-$C_{12}$ substituted aryl, H, in one aspect $C_1$-$C_3$ alkyl, $C_1$-$C_3$ substituted alkyl, $C_6$ aryl, and $C_6$ substituted aryl, or H, with the proviso that at least one $R_6$ on each of the nitrogen atoms is H; and when E is selected from

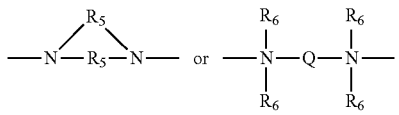

and when z is 1, the respective D is selected from H, —$CH_3$, or $R_6$; when E is

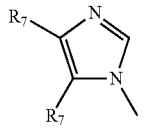

z is 0 and B is

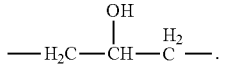

When a sample of silicone is analyzed, it is recognized by the skilled artisan that such sample may have, on average, the non-integer indices for Formulas (I)-(III) above, but that such average indices values will be within the ranges of the indices for Formulas (I)-(III) above.

Silicone Emulsion

The silicone may be added to, or is present in, the composition as an emulsion, or even a nanoemulsion. Preparation of silicone emulsions is well known to a person skilled in the art; see, for example, U.S. Pat. No. 7,683,119 and U.S. Patent Application 2007/0203263A1.

The silicone emulsion may be characterized by a mean particle size of from about 10 nm to about 1000 nm, or from about 20 nm to about 800 nm, or from about 40 nm to about 500 nm, or from about 75 nm to about 250 nm, or from about 100 nm to about 150 nm. Particle size of the emulsions is measured by means of a laser light scattering technique, using a Horiba model LA-930 Laser Scattering Particle Size Distribution Analyzer (Horiba Instruments, Inc.), according to the manufacturer's instructions.

The silicone emulsions of the present disclosure may comprise any of the aforementioned types of silicone polymers. Suitable examples of silicones that may comprise the emulsion include aminosilicones, such as those described herein.

The silicone-containing emulsion of the present disclosure may comprise from about 1% to about 60%, or from about 5% to about 40%, or from about 10% to about 30%, by weight of the emulsion, of the silicone compound.

The silicone emulsion may comprise one or more solvents. The silicone emulsion of the present disclosure may comprise from about 0.1% to about 20%, or to about 12%, or to about 5%, by weight of the silicone, of one or more solvents, provided that the silicone emulsion comprises less than about 50%, or less than about 45%, or less than about 40%, or less than about 35%, or less than about 32% of solvent and surfactant combined, by weight of the silicone. The silicone emulsion may comprise from about 1% to about 5% or from about 2% to about 5% of one or more solvents, by weight of the silicone.

The solvent may be selected from monoalcohols, polyalcohols, ethers of monoalcohols, ethers of polyalcohols, or mixtures thereof. Typically, the solvent has a hydrophilic-lipophilic balance (HLB) ranging from about 6 to about 14. More typically, the HLB of the solvent will range from about 8 to about 12, most typically about 11. One type of solvent may be used alone or two or more types of solvents may be used together. The solvent may comprise a glycol ether, an alkyl ether, an alcohol, an aldehyde, a ketone, an ester, or a mixture thereof. The solvent may be selected from a monoethylene glycol monoalkyl ether that comprises an alkyl group having 4-12 carbon atoms, a diethylene glycol monoalkyl ether that comprises an alkyl group having 4-12 carbon atoms, or a mixture thereof.

The silicone emulsion of the present disclosure may comprise from about 1% to about 40%, or to about 30%, or to about 25%, or to about 20%, by weight of the silicone, of one or more surfactants, provided that the combined weight of the surfactant plus the solvent is less than about 50%, or less than about 45%, or less than about 40%, or less than about 35%, or less than about 32%, by weight of the silicone. The silicone emulsion may comprise from about 5% to about 20% or from about 10% to about 20% of one or more surfactants, by weight of the silicone. The surfactant may be selected from anionic surfactants, nonionic surfactants, cationic surfactants, zwitterionic surfactants, amphoteric surfactants, ampholytic surfactants, or mixtures thereof, preferably nonionic surfactant. It is believed that surfactant, particularly nonionic surfactant, facilitates uniform dispersing of the silicone fluid compound and the solvent in water.

Suitable nonionic surfactants useful herein may comprise any conventional nonionic surfactant. Typically, total HLB (hydrophilic-lipophilic balance) of the nonionic surfactant that is used is in the range of about 8-16, more typically in the range of 10-15. Suitable nonionic surfactants may be selected from polyoxyalkylene alkyl ethers, polyoxyalkylene alkyl phenol ethers, alkyl polyglucosides, polyvinyl alcohol and glucose amide surfactant. Particularly preferred are secondary alkyl polyoxyalkylene alkyl ethers. Examples of suitable nonionic surfactants include C11-15 secondary alkyl ethoxylate such as those sold under the trade name Tergitol 15-S-5, Tergitol 15-S-12 by Dow Chemical Company of Midland Mich. or Lutensol XL-100 and Lutensol XL-50 by BASF, AG of Ludwigschaefen, Germany. Other preferred nonionic surfactants include $C_{12}$-$C_{18}$ alkyl ethoxylates, such as, NEODOL® nonionic surfactants from Shell, e.g., NEODOL® 23-5 and NEODOL® 26-9. Examples of branched polyoxyalkylene alkyl ethers include those with one or more branches on the alkyl chain such as those available from Dow Chemicals of Midland, Mich. under the trade name Tergitol TMN-6 and Tergiotol TMN-3. Other preferred surfactants are listed in U.S. Pat. No. 7,683,119.

The silicone emulsion of the present disclosure may comprise from about 0.01% to about 2%, or from about 0.1% to about 1.5%, or from about 0.2% to about 1%, or from about 0.5% to about 0.75% of a protonating agent. The protonating agent is generally a monoprotic or multiprotic, water-soluble or water-insoluble, organic or inorganic acid. Suitable protonating agents include, for example, formic acid, acetic acid, propionic acid, malonic acid, citric acid, hydrochloric acid, sulfuric acid, phosphoric acid, nitric acid, or a mixture thereof, preferably acetic acid. Generally, the acid is added in the form of an acidic aqueous solution. The protonating agent is typically added in an amount necessary to achieve an emulsion pH of from about 3.5 to about 7.0.

Surfactant System

The compositions of the present disclosure comprise a surfactant system. Surfactant systems are known to effect cleaning benefits. However, it has been found that careful selection of particular surfactant systems can also provide feel and/or deposition benefits when used in combination with particular deposition polymers and silicone.

Typically, the detergent compositions of the present disclosure comprise a surfactant system in an amount sufficient to provide desired cleaning properties. In some embodiments, the detergent composition comprises, by weight of the composition, from about 1% to about 70% of a surfactant system. In other embodiments, the cleaning composition comprises, by weight of the composition, from about 2% to about 60% of the surfactant system. In further embodiments, the cleaning composition comprises, by weight of the composition, from about 5% to about 30% of the surfactant system. In some embodiments, the cleaning composition comprises from about 20% to about 60%, or from about 35% to about 50%, by weight of the composition, of the surfactant system.

The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material. As used herein, fatty acids and their salts are understood to be part of the surfactant system.

Anionic Surfactant/Nonionic Surfactant Combinations

The surfactant system typically comprises anionic surfactant and nonionic surfactant in a weight ratio. The careful selection of the weight ratio of anionic surfactant to nonionic surfactant is important in order for the presently disclosed compositions to provide the desired levels of feel and cleaning benefits.

In some aspects, the weight ratio of anionic surfactant to nonionic surfactant is from about 1.1:1 to about 4:1, or from about 1.1:1 to about 2.5:1, or from about 1.5:1 to about 2.5:1, or from about 1.8:1 to about 2.2:1, or about 2:1. Anionic surfactants and nonionic surfactants are described in more detail below.

Anionic Surfactants

The surfactant system comprises anionic surfactant. In some examples, the surfactant system of the cleaning composition may comprise from about 1% to about 70%, by weight of the surfactant system, of one or more anionic surfactants. In other examples, the surfactant system of the cleaning composition may comprise from about 2% to about 60%, by weight of the surfactant system, of one or more anionic surfactants. In further examples, the surfactant system of the cleaning composition may comprise from about 5% to about 30%, by weight of the surfactant system, of one or more anionic surfactants. Specific, non-limiting examples of suitable anionic surfactants include any conventional anionic surfactant. This may include a sulfate detersive surfactant, e.g., alkoxylated and/or non-alkoxylated alkyl sulfate material, and/or sulfonic detersive surfactants, e.g., alkyl benzene sulfonates. In some aspects, the anionic surfactant of the surfactant system comprises a sulfonic detersive surfactant and a sulfate detersive surfactant, preferably linear alkyl benzene sulfonate (LAS) and alkyl ethoxylated sulfate (AES), in a weight ratio. In some aspects, the weight ratio of sulfonic detersive surfactant, e.g., LAS, to sulfate detersive surfactant, e.g., AES, is from about 1:9 to about 9:1, or from about 1:6 to about 6:1, or from about 1:4 to about 4:1, or from about 1:2 to about 2:1, or from about 0.5:1 to about 2:1, or from about 0.5:1 to about 1.5:1, or about 1:1. In some aspects, the weight ratio of sulfonic detersive surfactant, e.g., LAS, to sulfate detersive surfactant, e.g., AES, is from about 1:9, or from about 1:6, or from about 1:4, or from about 1:2, to about 1:1. In some aspects, increasing the level of AES compared to the level of LAS facilitates improved silicone deposition.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 25 carbon atoms, and an average (arithmetic mean) degree of ethoxylation of from about 1 mol to 4 mols of ethylene oxide, and in some examples an average (arithmetic mean) degree of ethoxylation of 1.8 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide.

Non-ethoxylated alkyl sulfates may also be added to the disclosed cleaning compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^- M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration, e.g. those of the type described in U.S. Pat. Nos. 2,220,099 and 2,477,383. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS. Such surfactants and their preparation are described for example in U.S. Pat. Nos. 2,220,099 and 2,477,383.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants useful herein may be found in U.S. Pat. No. 4,285,841, Barrat et al., issued Aug. 25, 1981, and in U.S. Pat. No. 3,919,678, Laughlin, et al., issued Dec. 30, 1975, both of which are herein incorporated by reference.

Fatty Acids

Other anionic surfactants useful herein are fatty acids and/or their salts. Therefore, in some aspects, the detergent composition comprises a fatty acid and/or its salt. Without wishing to be bound by theory, it is believed that in the present compositions, fatty acids and/or their salts act as a builder and contributes to fabric softness. However, fatty acid is not required in the present compositions, and there may be processing, cost, and stability advantages to minimizing fatty acid, or even eliminating it completely.

The composition may comprise from about 0.1%, or from about 0.5%, or from about 1%, to about 40%, or to about 30%, or to about 20%, or to about 10%, to about 8%, or to about 5%, or to about 4%, or to about 3.5% by weight of a fatty acid or its salt. In some aspects, the detergent composition is substantially free (or comprises 0%) of fatty acids and their salts.

Suitable fatty acids and salts include those having the formula R1COOM, where R1 is a primary or secondary alkyl group of 4 to 30 carbon atoms, and where M is a hydrogen cation or another solubilizing cation. In the acid form, M is a hydrogen cation; in the salt form, M is a solubilizing cation that is not hydrogen. While the acid (i.e., wherein M is a hydrogen cation) is suitable, the salt is typically preferred since it has a greater affinity for the cationic polymer. Therefore, the fatty acid or salt is preferably selected such that the pKa of the fatty acid or salt is less than the pH of the non-aqueous liquid composition. In some aspects, the composition preferably has a pH of from 6 to 10.5, more preferably 6.5 to 9, most preferably 7 to 8.

The alkyl group represented by R1 may represent a mixture of chain lengths and may be saturated or unsaturated, although it is preferred that at least two thirds of the R1 groups have a chain length of between 8 and 18 carbon atoms. Non-limiting examples of suitable alkyl group sources include the fatty acids derived from coconut oil, tallow, tall oil, rapeseed-derived, oleic, fatty alkylsuccinic, palm kernel oil, and mixtures thereof. For the purposes of minimizing odor, however, it is often desirable to use primarily saturated carboxylic acids.

The solubilizing cation, M (when M is not a hydrogen cation), may be any cation that confers water solubility to the product, although monovalent moieties are generally preferred. Examples of suitable solubilizing cations for use with this disclosure include alkali metals such as sodium and potassium, which are particularly preferred, and amines such as monoethanolamine, triethanolammonium, ammonium, and morpholinium. Although, when used, the majority of the fatty acid should be incorporated into the composition in neutralized salt form, it is often preferable to leave an amount of free fatty acid in the composition, as this can aid in the maintenance of the viscosity of the composition, particularly when the composition has low water content, for example less than 20%.

Branched Surfactants

The anionic surfactant may comprise anionic branched surfactants. Suitable anionic branched surfactants may be selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups.

In some aspects, the branched detersive surfactant is a mid-chain branched detersive surfactant, typically, a mid-chain branched anionic detersive surfactant, for example, a mid-chain branched alkyl sulphate and/or a mid-chain branched alkyl benzene sulphonate. In some aspects, the detersive surfactant is a mid-chain branched alkyl sulphate. In some aspects, the mid-chain branches are $C_{1-4}$ alkyl groups, typically methyl and/or ethyl groups.

In some aspects, the branched surfactant comprises a longer alkyl chain, mid-chain branched surfactant compound of the formula:

$$A_b\text{-X—B}$$

where:

(a) $A_b$ is a hydrophobic C9 to C22 (total carbons in the moiety), typically from about C12 to about C18, mid-chain branched alkyl moiety having: (1) a longest linear carbon chain attached to the —X—B moiety in the range of from 8 to 21 carbon atoms; (2) one or more C1-C3 alkyl moieties branching from this longest linear carbon chain; (3) at least one of the branching alkyl moieties is attached directly to a carbon of the longest linear carbon chain at a position within the range of position 2 carbon (counting from carbon #1 which is attached to the —X—B moiety) to position ω-2 carbon (the terminal carbon minus 2 carbons, i.e., the third carbon from the end of the longest linear carbon chain); and (4) the surfactant composition has an average total number of carbon atoms in the $A_b$-X moiety in the above formula within the range of greater than 14.5 to about 17.5 (typically from about 15 to about 17);

b) B is a hydrophilic moiety selected from sulfates, sulfonates, amine oxides, polyoxyalkylene (such as polyoxyethylene and polyoxypropylene), alkoxylated sulfates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkylated/polyhydroxyalkylated quats, alkylated/polyhydroxylated oxypropyl quats, imidazolines, 2-ylsuccinates, sulfonated alkyl esters, and sulfonated fatty acids (it is to be noted that more than one hydrophobic moiety may be attached to B, for example as in $(A_b\text{-X})_z$—B to give dimethyl quats); and (c) X is selected from —CH2- and —C(O)—.

Generally, in the above formula the $A_b$ moiety does not have any quaternary substituted carbon atoms (i.e., 4 carbon atoms directly attached to one carbon atom). Depending on which hydrophilic moiety (B) is selected, the resultant surfactant may be anionic, nonionic, cationic, zwitterionic, amphoteric, or ampholytic. In some aspects, B is sulfate and the resultant surfactant is anionic.

In some aspects, the branched surfactant comprises a longer alkyl chain, mid-chain branched surfactant compound of the above formula wherein the $A_b$ moiety is a branched primary alkyl moiety having the formula:

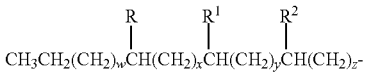

wherein the total number of carbon atoms in the branched primary alkyl moiety of this formula (including the R, $R^1$, and $R^2$ branching) is from 13 to 19; R, R1, and R2 are each independently selected from hydrogen and C1-C3 alkyl (typically methyl), provided R, R1, and R2 are not all hydrogen and, when z is 0, at least R or R1 is not hydrogen; w is an integer from 0 to 13; x is an integer from 0 to 13; y is an integer from 0 to 13; z is an integer from 0 to 13; and w+x+y+z is from 7 to 13.

In certain aspects, the branched surfactant comprises a longer alkyl chain, mid-chain branched surfactant compound of the above formula wherein the $A_b$ moiety is a branched primary alkyl moiety having the formula selected from:

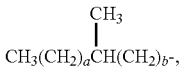

(I)

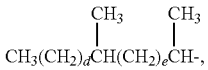

(II)

or mixtures thereof; wherein a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

when d+e=12, d is an integer from 2 to 11 and e is an integer from 1 to 10;

when d+e=13, d is an integer from 2 to 12 and e is an integer from 1 to 11;

when d+e=14, d is an integer from 2 to 13 and e is an integer from 1 to 12.

In the mid-chain branched surfactant compounds described above, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties.

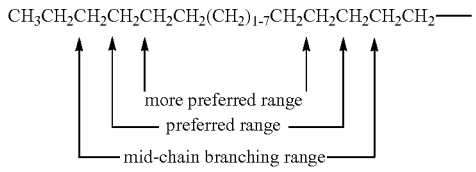

For mono-methyl substituted surfactants, these ranges exclude the two terminal carbon atoms of the chain and the carbon atom immediately adjacent to the —X—B group.

The formula below illustrates the mid-chain branching range, preferred mid-chain branching range, and more preferred mid-chain branching range for di-methyl substituted alkyl $A^b$ moieties.

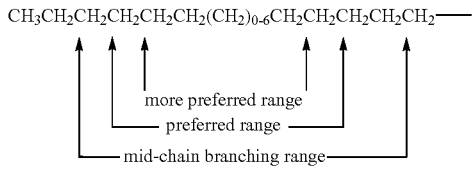

Additional suitable branched surfactants are disclosed in U.S. Pat. No. 6,008,181, U.S. Pat. No. 6,060,443, U.S. Pat. No. 6,020,303, U.S. Pat. No. 6,153,577, U.S. Pat. No. 6,093,856, U.S. Pat. No. 6,015,781, U.S. Pat. No. 6,133,222, U.S. Pat. No. 6,326,348, U.S. Pat. No. 6,482,789, U.S. Pat. No. 6,677,289, U.S. Pat. No. 6,903,059, U.S. Pat. No. 6,660,711, U.S. Pat. No. 6,335,312, and WO 99/8929. Yet other suitable branched surfactants include those described in WO9738956, WO9738957, and WO0102451.

In some aspects, the branched anionic surfactant comprises a branched modified alkylbenzene sulfonate (MLAS), as discussed in WO 99/05243, WO 99/05242, WO 99/05244, WO 99/05082, WO 99/05084, WO 99/05241, WO 99/07656, WO 00/23549, and WO 00/23548.

In some aspects, the branched anionic surfactant comprises a C12/13 alcohol-based surfactant comprising a methyl branch randomly distributed along the hydrophobe chain, e.g., Safol®, Marlipal® available from Sasol.

Further suitable branched anionic detersive surfactants include surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. These branched alcohols and surfactants are described in US20110033413.

Other suitable branched surfactants include those disclosed in U.S. Pat. No. 6,037,313 (P&G), WO9521233

(P&G), U.S. Pat. No. 3,480,556 (Atlantic Richfield), U.S. Pat. No. 6,683,224 (Cognis), US20030225304A1 (Kao), US2004236158A1 (R&H), U.S. Pat. No. 6,818,700 (Atofina), US2004154640 (Smith et al), EP1280746 (Shell), EP1025839 (L'Oreal), U.S. Pat. No. 6,765,119 (BASF), EP1080084 (Dow), U.S. Pat. No. 6,723,867 (Cognis), EP1401792A1 (Shell), EP1401797A2 (Degussa AG), US2004048766 (Raths et al), U.S. Pat. No. 6,596,675 (L'Oreal), EP1136471 (Kao), EP961765 (Albemarle), U.S. Pat. No. 6,580,009 (BASF), US2003105352 (Dado et al), U.S. Pat. No. 6,573,345 (Cryovac), DE10155520 (BASF), U.S. Pat. No. 6,534,691 (du Pont), U.S. Pat. No. 6,407,279 (ExxonMobil), U.S. Pat. No. 5,831,134 (Peroxid-Chemie), U.S. Pat. No. 5,811,617 (Amoco), U.S. Pat. No. 5,463,143 (Shell), U.S. Pat. No. 5,304,675 (Mobil), U.S. Pat. No. 5,227,544 (BASF), U.S. Pat. No. 5,446,213A (MITSUBISHI KASEI CORPORATION), EP1230200A2 (BASF), EP1159237B1 (BASF), US20040006250A1 (NONE), EP1230200B1 (BASF), WO2004014826A1 (SHELL), U.S. Pat. No. 6,703,535B2 (CHEVRON), EP1140741B1 (BASF), WO2003095402A1 (OXENO), U.S. Pat. No. 6,765,106B2 (SHELL), US20040167355A1 (NONE), U.S. Pat. No. 6,700,027B1 (CHEVRON), US20040242946A1 (NONE), WO2005037751A2 (SHELL), WO2005037752A1 (SHELL), U.S. Pat. No. 6,906,230B1 (BASF), WO2005037747A2 (SHELL) OIL COMPANY.

Additional suitable branched anionic detersive surfactants include surfactant derivatives of isoprenoid-based polybranched detergent alcohols, as described in US 2010/0137649. Isoprenoid-based surfactants and isoprenoid derivatives are also described in the book entitled "Comprehensive Natural Products Chemistry: Isoprenoids Including Carotenoids and Steroids (Vol. two)", Barton and Nakanishi, © 1999, Elsevier Science Ltd and are included in the structure E, and are hereby incorporated by reference.

Further suitable branched anionic detersive surfactants include those derived from anteiso and iso-alcohols. Such surfactants are disclosed in WO2012009525.

Additional suitable branched anionic detersive surfactants include those described in US Patent Application Nos. 2011/0171155A1 and 2011/0166370A1.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

The surfactant system disclosed herein may comprise any of the branched surfactants described above individually or the surfactant system may comprise a mixture of the branched surfactants described above. Furthermore, each of the branched surfactants described above may include a bio-based content. In some aspects, the branched surfactant has a bio-based content of at least about 50%, at least about 60%, at least about 70%, at least about 80%, at least about 90%, at least about 95%, at least about 97%, or about 100%.

Nonionic Surfactants

The surfactant systems of the cleaning composition typically comprise nonionic surfactant. In some examples, the surfactant system comprises up to about 50%, by weight of the surfactant system, of one or more nonionic surfactants, e.g., as a co-surfactant. In some aspects, the surfactant system comprises from about 5% to about 50%, or from about 10% to about 50%, or from about 20% to about 50%, by weight of the surfactant system, of nonionic surfactant.

Suitable nonionic surfactants useful herein can comprise any conventional nonionic surfactant. These can include, for e.g., alkoxylated fatty alcohols and amine oxide surfactants. In some examples, the cleaning compositions may contain an ethoxylated nonionic surfactant. These materials are described in U.S. Pat. No. 4,285,841, Barrat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one example, the nonionic surfactant is selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 to Llenado, issued Jan. 26, 1986; specifically alkylpolyglycosides as discussed in U.S. Pat. No. 4,483,780 and U.S. Pat. No. 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

Cationic Surfactants

The surfactant system may comprise a cationic surfactant. In some aspects, the surfactant system comprises from about 0% to about 7%, or from about 0.1% to about 5%, or from about 1% to about 4%, by weight of the surfactant system, of a cationic surfactant, e.g., as a co-surfactant. Non-limiting examples of cationic include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660, 4,260,529 and U.S. Pat. No. 6,022,844; and amino surfactants as discussed in U.S. Pat. No. 6,221,825 and WO 00/47708, specifically amido propyldimethyl amine (APA).

In some aspects, the cleaning compositions of the present disclosure are substantially free of cationic surfactants and/or of surfactants that become cationic below a pH of 7 or below a pH of 6.

Zwitterionic Surfactants

In some aspects, the surfactant system comprises a zwitterionic surfactant. Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N, N-dimethylamino-1-propane sulfonate where the alkyl group can be $C_8$ to $C_{18}$ and in certain embodiments from $C_{10}$ to $C_{14}$.

Ampholytic Surfactants

In some aspects, the surfactant system comprises an ampholytic surfactant. Specific, non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Amphoteric Surfactants

In some aspects, the surfactant system comprises an amphoteric surfactant. Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. See U.S. Pat. No. 3,929,678 to Laughlin et al., issued Dec. 30, 1975 at column 19, lines 18-35, for examples of amphoteric surfactants. In some aspects, the surfactant system is substantially free of amphoteric surfactant.

In one aspect, the surfactant system comprises an anionic surfactant and, as a co-surfactant, a nonionic surfactant, for example, a $C_{12}$-$C_{18}$ alkyl ethoxylate. In another aspect, the surfactant system comprises $C_{10}$-$C_{15}$ alkyl benzene sulfonates (LAS) and, as a co-surfactant, an anionic surfactant, e.g., $C_{10}$-$C_{18}$ alkyl alkoxy sulfates ($AE_xS$), where x is from 1-30. In another aspect, the surfactant system comprises an anionic surfactant and, as a co-surfactant, a cationic surfactant, for example, dimethyl hydroxyethyl lauryl ammonium chloride.

Laundry Adjuncts

The laundry detergent compositions described herein may comprise other laundry adjuncts, including external structuring systems, enzymes, microencapsulates such as perfume microcapsules, soil release polymers, hueing agents, and mixtures thereof.

External Structuring System

When the detergent composition is a liquid composition, the detergent composition may comprise an external structuring system. The structuring system may be used to provide sufficient viscosity to the composition in order to provide, for example, suitable pour viscosity, phase stability, and/or suspension capabilities.

The composition of the present disclosure may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants.

Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear (0.05 $s^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C.

In one embodiment, the compositions may comprise from about 0.01% to about 1% by weight of a non-polymeric crystalline, hydroxyl functional structurant. Such non-polymeric crystalline, hydroxyl functional structurants may comprise a crystallizable glyceride which can be pre-emulsified to aid dispersion into the final unit dose laundry detergent composition. Suitable crystallizable glycerides include hydrogenated castor oil or "HCO" or derivatives thereof, provided that it is capable of crystallizing in the liquid detergent composition.

The detergent composition may comprise from about 0.01% to 5% by weight of a naturally derived and/or synthetic polymeric structurant. Suitable naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable synthetic polymeric structurants include: polycarboxylates, polyacrylates, hydrophobically modified ethoxylated urethanes, hydrophobically modified non-ionic polyols and mixtures thereof. In one aspect, the polycarboxylate polymer may be a polyacrylate, polymethacrylate or mixtures thereof. In another aspect, the polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

Suitable structurants and methods for making them are disclosed in U.S. Pat. No. 6,855,680 and WO 2010/034736.

Enzymes

The cleaning compositions of the present disclosure may comprise enzymes. Enzymes may be included in the cleaning compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, carbohydrases, cellulases, oxidases, peroxidases, mannanases, and mixtures thereof of any suitable origin, such as vegetable, animal, bacterial, fungal, and yeast origin. Other enzymes that may be used in the cleaning compositions described herein include hemicellulases, gluco-amylases, xylanases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidases, chondroitinases, laccases, or mixtures thereof. Enzyme selection is influenced by factors such as pH-activity and/or stability optima, thermostability, and stability to active detergents, builders, and the like.

In some aspects, lipase may be included. Additional enzymes that may be used in certain aspects include mannanase, protease, and cellulase. Mannanase, protease, and cellulase may be purchased under the trade names, respectively, Mannaway, Savinase, and Celluclean, from Novozymes (Denmark), providing, respectively, 4 mg, 15.8 mg, and 15.6 mg active enzyme per gram.

In some aspects, the composition comprises at least two, or at least three, or at least four enzymes. In some aspects, the composition comprises at least an amylase and a protease.

Enzymes are normally incorporated into cleaning compositions at levels sufficient to provide a "cleaning-effective amount." The phrase "cleaning effective amount" refers to any amount capable of producing a cleaning, stain removal, soil removal, whitening, deodorizing, or freshness improving effect on soiled material such as fabrics, hard surfaces, and the like. In some aspects, the detergent compositions may comprise from about 0.0001% to about 5%, or from about 0005% to about 3%, or from about 0.001% to about 2%, of active enzyme by weight of the cleaning composition. The enzymes can be added as a separate single ingredient or as mixtures of two or more enzymes.

A range of enzyme materials and means for their incorporation into synthetic cleaning compositions is disclosed in WO 9307263 A; WO 9307260 A; WO 8908694 A; U.S. Pat. Nos. 3,553,139; 4,101,457; and U.S. Pat. No. 4,507,219. Enzyme materials useful for liquid cleaning compositions, and their incorporation into such compositions, are disclosed in U.S. Pat. No. 4,261,868.

Microencapsulates and Delivery Systems

In some aspects, the composition disclosed herein may comprise microencapsulates. The microencapsulates may comprise a suitable benefit agent such as perfume raw materials, silicone oils, waxes, hydrocarbons, higher fatty acids, essential oils, lipids, skin coolants, vitamins, sunscreens, antioxidants, glycerine, catalysts, bleach particles, silicon dioxide particles, malodor reducing agents, odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers, anti-foaming agents, UV protection agents, sun fade inhibitors, anti-allergenic agents, enzymes, water proofing agents, fabric comfort agents, shrinkage resistance agents, stretch resistance agents, stretch recovery agents, skin care agents, glycerin, and natural actives, antibacterial actives, antiperspirant actives, cationic polymers, dyes and mixtures thereof. In some aspects, the microencapsulate is a perfume microcapsule as described below.

In some aspects, the compositions disclosed herein may comprise a perfume delivery system. Suitable perfume delivery systems, methods of making certain perfume delivery systems, and the uses of such perfume delivery systems are disclosed in USPA 2007/0275866 A1. Such perfume delivery system may be a perfume microcapsule. The perfume microcapsule may comprise a core that comprises perfume and a shell, with the shell encapsulating the core. The shell may comprise a material selected from the group consisting of aminoplast copolymer, an acrylic, an acrylate, and mixtures thereof. The aminoplast copolymer may be melamine-formaldehyde, urea-formaldehyde, cross-linked melamine formaldehyde, or mixtures thereof. In some aspects, the shell comprises a material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate and mixtures thereof. The perfume microcapsule's shell may be coated with one or more materials, such as a polymer, that aids in the deposition and/or retention of the perfume microcapsule on the site that is treated with the composition disclosed herein. The polymer may be a cationic polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, poly vinyl amine, copolymers of poly vinyl amine and N-vinyl formamide, and mixtures thereof. Typically, the core comprises raw perfume oils. The perfume microcapsule may be friable and/or have a mean particle size of from about 10 microns to about 500 microns or from about 20 microns to about 200 microns. In some aspects, the composition comprises, based on total composition weight, from about 0.01% to about 80%, or from about 0.1% to about 50%, or from about 1.0% to about 25%, or from about 1.0% to about 10% of perfume microcapsules. Suitable capsules may be obtained from Appleton Papers Inc., of Appleton, Wis. USA.

Formaldehyde scavengers may also be used in or with such perfume microcapsules. Suitable formaldehyde scavengers may include: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or a mixture thereof.

Suitable encapsulates and benefit agents are discussed further in U.S. Patent Applications 2008/0118568A1, US2011/026880, US2011/011999, 2011/0268802A1, and US20130296211, each assigned to The Procter & Gamble Company and incorporated herein by reference.

Soil Release Polymers (SRPs)

The detergent compositions of the present disclosure may comprise a soil release polymer. In some aspects, the detergent compositions may comprise one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr\text{-}CO\text{-}]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clariant. Other suitable soil release polymers are Marloquest polymers, such as Marloquest SL supplied by Sasol.

Hueing Agents

The compositions may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503. In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet Conn., carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present disclosure may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Other Laundry Adjuncts

The detergent compositions described herein may comprise other conventional laundry adjuncts. Suitable laundry adjuncts include builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 EO20 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, anti-microbial agents and/or preservatives, neutralizers and/or pH adjusting agents, processing aids, opacifiers, pearlescent agents, pigments, or mixtures thereof. Typical usage levels range from as low as 0.001% by weight of composition for adjuncts such as optical brighteners and sunscreens to 50% by weight of composition for builders. Suitable adjuncts are described in U.S. patent application Ser. No. 14/226,878, and U.S. Pat. Nos. 5,705,464, 5,710,115, 5,698,504, 5,695,679, 5,686,014 and 5,646,101, each of which is incorporated herein by reference.

Method of Making the Cleaning or Laundry Detergent Composition

Incorporation of the cationic polymer and various other ingredients as described hereinabove into cleaning or laundry detergent compositions of the present disclosure can be done in any suitable manner and can, in general, involve any order of mixing or addition.

For example, the cationic polymer as received from the manufacturer can be introduced directly into a preformed mixture of two or more of the other components of the final composition. This can be done at any point in the process of preparing the final composition, including at the very end of the formulating process. That is, the cationic polymer can be added to a pre-made liquid laundry detergent to form the final composition of the present disclosure.

In another example, the cationic polymer can be premixed with an emulsifier, a dispersing agent, or a suspension agent to form an emulsion, a latex, a dispersion, a suspension, and the like, which is then mixed with other components (such as the silicone, detersive surfactants, etc.) of the final composition. These components can be added in any order and at any point in the process of preparing the final composition. In some aspects, the silicone, for example the silicone emulsion, is added to a base detergent before the cationic polymer is added. In some aspects, the cationic polymer is added to a base detergent before the silicone is added.

A third example involves mixing the cationic polymer with one or more adjuncts of the final composition and adding this premix to a mixture of the remaining adjuncts.

Liquid compositions according to the present disclosure may be made according to conventional methods, for example in a batch process or in a continuous loop process. Dry (e.g., powdered or granular) compositions may be made according to conventional methods, for example by spray-drying or blow-drying a slurry comprising the components described herein The detergent compositions described herein may be encapsulated in a pouch, preferably a pouch made of water-soluble film, to form a unit dose article that may be used to treat fabrics.

Methods of Using the Laundry Detergent Composition

The present disclosure is directed to a method of treating a fabric, the method comprising the step of contacting a fabric with a detergent composition described herein. The method may further comprise the step of carrying out a washing or cleaning operation. Water may be added before, during, or after the contacting step to form a wash liquor.

The present disclosure also relates to a process for the washing, for example by machine, of fabric, preferably soiled fabric, using a composition according to the present disclosure, comprising the steps of, placing a detergent composition according to the present disclosure into contact with the fabric to be washed, and carrying out a washing or cleaning operation.

Any suitable washing machine may be used, for example, a top-loading or front-loading automatic washing machine. Those skilled in the art will recognize suitable machines for the relevant wash operation. The article of the present disclosure may be used in combination with other compositions, such as fabric additives, fabric softeners, rinse aids, and the like. Additionally, the detergent compositions of the present disclosure may be used in known hand washing methods.

In some aspects, the present disclosure is directed to a method of treating a fabric, the method comprising the steps of contacting a fabric with a detergent composition described herein, carrying out a washing step, and then contacting the fabric with a fabric softening composition. The entire method, or at least the washing step, may be carried out by hand, be machine-assisted, or occur in an automatic washing machine. The step of contacting the fabric with a fabric softening composition may occur in the presence of water, for example during a rinse cycle of an automatic washing machine.

Test Methods

The following section describes the test methods used in the present disclosure.

Determining Weight Average Molecular Weight

The weight-average molecular weight (Mw) of a polymer material of the present invention is determined by Size Exclusion Chromatography (SEC) with differential refractive index detection (RI). One suitable instrument is Agilent® GPC-MDS System using Agilent® GPC/SEC software, Version 1.2 (Agilent, Santa Clara, USA). SEC separation is carried out using three hydrophilic hydroxylation polymethyl methacrylate gel columns (Ultrahydrogel 2000-250-120 manufactured by Waters, Milford, USA) directly joined to each other in a linear series and a solution of 0.1M sodium chloride and 0.3% trifluoroacetic acid in DI-water, which is filtered through 0.22 μm pore size GVWP membrane filter (MILLIPORE, Mass., USA). The RI detector needs to be kept at a constant temperature of about 5-10° C. above the ambient temperature to avoid baseline drift. It is set to 35° C. The injection volume for the SEC is 100 μL. Flow rate is set to 0.8 mL/min. Calculations and calibrations for the test polymer measurements are conducted against a set of 10 narrowly distributed Poly(2-vinylpyridin) standards from Polymer Standard Service (PSS, Mainz Germany) with peak molecular weights of: Mp=1110 g/mol; Mp=3140 g/mol; Mp=4810 g/mol; Mp=11.5 k g/mol; Mp=22 k g/mol; Mp=42.8 k g/mol; Mp=118 k g/mol; Mp=256 k g/mol; Mp=446 k g/mol; and Mp=1060 k g/mol.

Each test sample is prepared by dissolving the concentrated polymer solution into the above-described solution of 0.1M sodium chloride and 0.3% trifluoroacetic acid in DI water, to yield a test sample having a polymer concentration of 1 to 2 mg/mL. The sample solution is allowed to stand for 12 hours to fully dissolve, and then stirred well and filtered through a 0.45 μm pore size nylon membrane (manufactured by WHATMAN, UK) into an auto sampler vial using a 5 mL syringe. Samples of the polymer standards are prepared in a similar manner. Two sample solutions are prepared for each test polymer. Each solution is measured once. The two measurement results are averaged to calculate the Mw of the test polymer.

For each measurement, the solution of 0.1M sodium chloride and 0.3% trifluoroacetic acid in DI water is first injected onto the column as the background. A correction sample (a solution of 1 mg/mL polyethylene oxide with Mp=111.3 k g/mol) is analysed six times prior to other sample measurements, so as to verify repeatability and accuracy of the system.

The weight-average molecular weight (Mw) of the test sample polymer is calculated using the software that accompanies the instrument and selecting the menu options appropriate for narrow standard calibration modelling. A third-order polynomial curve is used to fit the calibration curve to the data points measured from the Poly(2-vinylpyridin) standards. The data regions used for calculating the weight-average molecular weight are selected based upon the strength of the signals detected by the RI detector. Data regions where the RI signals are greater than 3 times the respective baseline noise levels are selected and included in the Mw calculations. All other data regions are discarded and excluded from the Mw calculations. For those regions which fall outside of the calibration range, the calibration curve is extrapolated for the Mw calculation.

To measure the average molecular weight of a test sample containing a mixture of polymers of different molecular weights, the selected data region is cut into a number of equally spaced slices. The height or Y-value of each slice from the selected region represents the abundance (Ni) of a specific polymer (i), and the X-value of each slice from the selected region represents the molecular weight (Mi) of the specific polymer (i). The weight average molecular weight (Mw) of the test sample is then calculated based on the equation described hereinabove, i.e., $Mw=(\Sigma i\ Ni\ Mi2)/(\Sigma i\ Ni\ Mi)$.

Fabric Stripping

Before treated and tested, e.g., for silicone deposition, friction, and/or whiteness, the fabrics are typically "stripped" of any manufacturer's finish that may be present, dried, and then treated with a detergent composition.

Stripping can be achieved by washing new fabrics several times in a front-loading washing machine such as a Milnor model number 30022X8J. For stripping, each load includes 45-50 pounds of fabric, and each wash cycle uses approximately 25 gallons of water with 0 mg/L of calcium carbonate equivalents hardness and water temperature of 60° C. The machine is programmed to fill and drain 15 times for a total of 375 gallons of water. The first and second wash cycles contain 175 g of AATCC nil brightener liquid laundry detergent (2003 Standard Reference Liquid Detergent WOB (without optical brightener), such as from Testfabrics Inc., West Pittston, Pa., USA). Each wash cycle is followed by two rinses, and the second wash cycle is followed by three additional wash cycles without detergent or until no suds are observed. The fabrics are then dried in a tumble dryer until completely dry, and used in the fabric treatment/test method.

Silicone Deposition Test Method

Silicone deposition on fabric is measured according to the following test method. Typically, greater silicone deposition correlates with softer-feeling fabric. Silicone deposition is characterized on 100% cotton terry towels (ex Calderon, Indianapolis, Ind., USA) or 50%/50% Polyester/Cotton Jersey Knit (ex Test Fabrics, West Pittston, Pa., USA, 147 grams/meter$^2$) that have been prepared and treated with the detergent compositions of the present disclosure, according to the procedures described below.

Treatment of Fabrics a. North American Top Loading Machine

Stripped fabrics are treated with compositions of the present disclosure by dispensing the detergent into the wash cycle of a washing machine such as a top loading Kenmore 80 series. Each washing machine contains 2.5 kg of fabric including 100% cotton terry towels (~12 fabrics that are 30.5 cm×30.5 cm, RN37002LL available from Calderon Textiles, LLC 6131 W 80th St Indianapolis Ind. 46278), and 50/50 Polyester/cotton jersey knit fabrics #7422 (~10 fabric swatches, 30.5 cm×30.5 cm, available from Test Fabrics 415 Delaware Ave, West Pittston Pa. 18643), and two 100% cotton t-shirts (Gildan, size large). The stripped fabrics are treated with the compositions of the present disclosure by washing using a medium fill, 17 gallon setting with a 90° F. Wash and 60° F. Rinse using 6 grain per gallon water using the heavy duty cycle in the Kenmore 80 series. The detergent composition (64.5 g), is added to the water at the beginning of the cycle, followed by the fabric. Fabrics are dried using for example, a Kenmore series dryer, on the cotton/high setting for 50 min. The fabrics are treated for a total of 3 wash-dry cycles, then are analyzed for silicone deposition.

b. North American Front Loading Machine

Stripped fabrics are treated with compositions of the present disclosure by dispensing the detergent into the wash cycle of a front-loading washing machine such as a Whirlpool Duet Model 9200 (Whirlpool, Benton Harbor, Mich., USA). Each washing machine contains a fabric load that is composed of five 32 cm×32 cm 100% cotton terry wash cloths (such as RN37002LL from Calderon Textiles, Indianapolis, Ind., USA), plus additional ballast of approximately: Nine adult men's large 100% cotton ultra-heavy jersey t-shirts (such as Hanes brand); Nine 50% polyester/50% cotton pillowcases (such as item #03716100 from Standard Textile Co., Cincinnati, Ohio, USA); and Nine 14% polyester/86% cotton terry hand towels (such as item #40822301 from Standard Textile Co., Cincinnati. Ohio, USA). The amount of ballast fabric is adjusted so that the dry weight of the total fabric load including terry wash cloths equals 3.6-3.9 kg. Add 66 g of the test product (or the control detergent) to the dosing drawer of the machine. Select a normal cycle with 18.9 L of water with 120 mg/L of calcium carbonate equivalents and 32° C. wash temperature and 16° C. rinse temperature. At the end of the wash/rinse cycle, use any standard US tumble dryer to dry the fabric load until completely dry. Clean out the washing machine by rinsing with water using the same water conditions used in the wash cycle. Repeat the wash, rinse, dry, and washer clean out procedures with the fabric load for a total of 3 cycles.

c. Western European Front Loading Machine

Stripped fabrics are treated with compositions of the present disclosure by dispensing the detergent into the wash cycle of a front loading washing machine such as a Miele 1724. Each washing machine contains a 3 kg fabric load that is composed of 100% cotton terry wash cloths (~18 fabrics that are 32 cm×32 cm such as RN37002LL from Calderon Textiles, Indianapolis, Ind., USA), 50/50 polyester/cotton jersey knit fabrics #7422 (~7 fabric swatches, 30.5 cm×30.5 cm, available from Test Fabrics 415 Delaware Ave, West Pittston Pa. 18643), plus additional ballast of approximately: seven adult men's large 100% cotton ultra-heavy jersey t-shirts (such as Gildan brand); and two 14% polyester/86% cotton terry hand towels (such as item #40822301 from Standard Textile Co., Cincinnati, Ohio, USA). The amount of ballast fabric is adjusted so that the dry weight of the total fabric load including terry wash cloths equals 3 kg. Add 73 g of the test product (or the control detergent) to the dosing drawer of the machine. Select a cotton short cycle with 12 L of water with 15 gpg water and 30° C. wash temperature and 15° C. rinse temperature. At the end of the wash/rinse cycle, use any standard US tumble dryer to dry the fabric load until completely dry. Clean out the washing machine by rinsing with water using the same water conditions used in the wash cycle. Repeat the wash, rinse, dry, and washer clean out procedures with the fabric load for a total of 3 cycles.

Silicone Deposition Analysis

Treated fabrics (minimum n=3 per test treatment) are die-cut into 4 cm diameter circles and each circle is added to a 20 mL scintillation vial (ex VWR #66021-533) and the fabric weight is recorded. To this vial is added 12 mL of 50% Toluene/50% Methyl isobutyl ketone solvent mixture to extract non-polar silicones (eg. PDMS), or 9 mL of 15% Ethanol/85% Methyl isobutyl ketone solvent mixture is used to extract polar silicones (eg. amino-functionalized silicones). The vial containing the fabric and solvent is reweighed, and then is agitated on a pulsed vortexer (DVX-2500, VWR #14005-826) for 30 minutes.

The silicone in the extract is quantified using inductively coupled plasma optical emission spectrometry (ICP-OES, Perkin Elmer Optima 5300DV) relative to a calibration curve and is reported in micrograms of silicone per gram of fabric. The calibration curve is prepared using ICP calibration standards of known silicone concentration that are made using the same or a structurally comparable type of silicone raw material as the products being tested. The working range of the method is 8-2300 μg silicone per gram of fabric. Typically, at least 80 micrograms/gram of silicone deposition is required to be considered to be consumer noticeable.

EXAMPLES

The non-limiting examples below illustrate compositions according to the present disclosure.

Examples 1A-1G: Liquid Detergent Fabric Care Compositions

Liquid detergent fabric care compositions are made by mixing together the ingredients listed in the proportions shown in Table 1. Example 1G is a comparative formulation.

TABLE 1

| Ingredient (wt %) | 1A | 1B | 1C | 1E | 1F | 1G (comp) |
|---|---|---|---|---|---|---|
| $C_{12}$-$C_{15}$ alkyl polyethoxylate (1.8) sulfate[1] | 4.06 | 4.06 | 11.3 | 7.42 | 7.42 | 14.3 |
| $C_{11.8}$ linear alkylbenzene sulfonc acid[2] | 4.06 | 4.06 | — | 4.24 | 5.30 | 8.4 |
| $C_{12}$-$C_{14}$ alcohol 9 ethoxylate[3] | 4.0 | 4.0 | 11.3 | 7.42 | 7.42 | 0.95 |
| $C_{12}$-$C_{18}$ Fatty Acid[4] | — | — | 1.12 | 1.12 | — | 1.1 |
| Ratio of anionic surfactant: nonionic surfactant | 2:1 | 2:1 | 1.1:1 | 1.7:1 | 1.7:1 | 25:1 |
| 1,2 Propane diol[5] | 1.52 | 1.52 | 2.00 | 2.00 | 2.01 | 2.01 |
| Diethylene glycol | 1.21 | 1.21 | 1.33 | 1.33 | 1.33 | 1.33 |
| Ethanol | 0.79 | 0.79 | 0.98 | 0.98 | 0.98 | 0.98 |
| Na Cumene Sulfonate | 1.12 | 1.12 | 1.50 | 1.50 | — | — |
| Citric acid | 1.16 | 1.16 | 2.71 | 2.71 | 2.71 | 2.71 |
| Sodium tetraborate | 1.57 | 1.57 | 1.64 | 1.64 | 1.64 | 1.64 |
| Protease[6] (51.4 mg/g) | — | — | 0.23 | 0.23 | — | — |
| Amylase[7] (13.34 mg/g) | — | — | 0.03 | 0.03 | 0.03 | 0.03 |
| Whitezyme[7] | — | — | 0.002 | 0.002 | 0.002 | 0.002 |
| Fluorescent Whitening Agent[8] | 0.05 | 0.05 | 0.23 | 0.23 | 0.23 | 0.23 |
| Hueing Agent[9] | — | — | — | — | — | — |

TABLE 1-continued

| Ingredient (wt %) | 1A | 1B | 1C | 1E | 1F | 1G (comp) |
|---|---|---|---|---|---|---|
| Diethylenetriamine pentaacetic acids | 0.32 | 0.32 | 0.58 | 0.58 | 0.58 | 0.58 |
| Ethoxylated polyamine[10] | — | — | 2.50 | 2.50 | 2.50 | 2.50 |
| Grease Cleaning Alkoxylated Polyalkylenimine Polymer[11] | 1.98 | 1.98 | 1.69 | 1.69 | 1.67 | 1.67 |
| Zwitterionic ethoxylated quaternized sulfated hexamethylene diamine[12] | — | — | 1.45 | 1.45 | 1.45 | 1.45 |
| Hydrogenated castor oil[13] | 0.15 | 0.15 | 0.20 | 0.20 | 0.20 | 0.20 |
| Cationic polymer: copolymer of acrylamide and methacryloylamido propyl trimethylammonium chloride[14] | 0.2 | 0.2 | 0.2 | 0.2 | 0.2 | 0.2 |
| Perfume Microcapsules[16] | 0.19 | 0.19 | 0.26 | 0.26 | 0.26 | 0.26 |
| Organosiloxane polymer | 4.0[17] | 2.0[18] | 2.0[19] | 2.0[19] | 2.1[20] | 2.1[18] |
| Water, perfumes, dyes, buffers, solvents and other optional components | to 100%; pH 7.0-8.2 | to 100%; pH 8.0-8.2 | to 100%; pH 8.0-8.2 | to 100%; pH 8.0-8.2 | to 100%; pH 8.0-8.2 | to 100%; pH 8.0-8.2 |

Example 2A-F: Liquid or Gel Detergents

Liquid or gel detergent fabric care compositions are prepared by mixing the ingredients listed in the proportions shown in Table 2.

TABLE 2

| Ingredient (wt %) | 2A | 2B | 2C | 2D | 2E | 2F |
|---|---|---|---|---|---|---|
| $C_{12}$-$C_{15}$ alkyl polyethoxylate (3.0) sulfate[1] | 6.08 | 6.08 | 6.08 | 6.08 | 4.71 | 6.19 |
| $C_{11.8}$ linear alkylbenzene sulfonic acid[2] | 6.08 | 6.08 | 6.08 | 6.08 | 4.71 | 1.41 |
| $C_{12}$-$C_{14}$ alkyl 7-ethoxylate[3] | — | — | — | — | — | 3.66 |
| $C_{12}$-$C_{14}$ alcohol 9-ethoxylate[3] | 6.08 | 6.08 | 6.08 | 6.08 | 8.80 | — |
| $C_{12}$-$C_{18}$ Fatty Acid[4] | — | — | — | 5.06 | — | — |
| Ratio of anionic surfactant:nonionic surfactant | 2:1 | 2:1 | 2:1 | 2.8:1 | 1.1:1 | 2.1:1 |
| 1,2 Propane diol[5] | 1.16 | 1.16 | 1.16 | 1.16 | 0.94 | 3.68 |
| Ethanol | 0.80 | 0.80 | 0.80 | 0.80 | 0.62 | 0.71 |
| Sorbitol | 0.03 | 0.03 | 0.03 | 0.03 | 0.03 | — |
| Di Ethylene Glycol | 0.45 | 0.45 | 0.45 | 0.45 | 0.36 | — |
| Na Cumene Sulfonate | 1.30 | 1.30 | 1.30 | 1.30 | 1.30 | 1.27 |
| Citric acid | 3.95 | 3.95 | 3.95 | 3.95 | 1.75 | 2.69 |
| Protease[6] | 0.60 | 0.60 | 0.60 | 0.60 | 0.60 | — |
| Amylase[7] | 0.19 | 0.19 | 0.19 | 0.19 | 0.19 | — |
| Fluorescent Whitening Agent[8] | 0.02 | 0.02 | 0.02 | 0.02 | 0.02 | — |
| Diethylene Triamine Penta Methylene Phosphonic acid | 0.12 | — | — | — | — | — |
| Hydroxy Ethylidene 1,1 Di Phosphonic acid | — | 0.21 | 0.21 | 0.21 | 0.21 | 0.21 |
| Ethoxylated polyamine[10] | 0.50 | 0.50 | 0.50 | 0.50 | 0.50 | 0.50 |
| Grease Cleaning Alkoxylated Polyalkylenimine Polymer[11] | 0.47 | 0.47 | 0.47 | 0.47 | 0.47 | 0.47 |
| Zwitterionic ethoxylated quaternized sulfated hexamethylene diamine[12] | 0.26 | 0.26 | 0.26 | 0.26 | 0.26 | 0.26 |
| Hydrogenated castor oil[13] | 0.2 | 0.2 | 0.17 | 0.17 | 0.17 | 0.2 |
| Cationic polymer: copolymer of acrylamide and methacrylamido propyl | 0.2 | 0.2 | 0.2 | 0.2 | 0.2 | 0.2 |

TABLE 2-continued

| Ingredient (wt %) | 2A | 2B | 2C | 2D | 2E | 2F |
|---|---|---|---|---|---|---|
| trimethylammonium chloride and acrylic acid[14] | | | | | | |
| Perfume microcapsule[16] | 0.65 | 0.65 | 0.42 | 0.42 | 0.42 | 0.42 |
| Organosiloxane polymer[17] | 4.0 | 4.0 | 3.0 | 3.0 | 3.0 | 2.5 |
| Water, perfumes, dyes, buffers, neutralizers, stabilizers and other optional components | to 100% pH 8.0-8.2 | to 100% pH 8.0-8.2 | to 100% pH 8.0-8.2 | to 100% pH 8.0-8.2 | to 100% pH 8.0-8.2 | to 100% pH 8.0-8.2 |

Example 3A-E: Unit Dose Liquid Detergents

Liquid or gel detergents that can be in the form of soluble mono- or multi-compartment unit dose (e.g., liquid detergent surrounded by a polyvinylalcohol film, such as M8630, available from MonoSol, LLC (Merrillville, Ind., USA), or films according to those disclosed in US Patent Application 2011/0188784A1) are prepared by mixing the ingredients listed in the proportions shown in Table 3.

TABLE 3

| Ingredient (wt %) | 3A | 3B | 3C | 3D | 3E |
|---|---|---|---|---|---|
| $C_{12}$-$C_{15}$ alkyl polyethoxylate (3.0) sulfate[1] | 8.8 | 8.8 | 5.6 | 13.7 | 15 |
| $C_{11.8}$ linear alkylbenzene sulfonic acid[2] | 18.6 | 18.6 | 18.2 | 13.7 | 18.6 |
| $C_{14}$-$C_{15}$ alkyl 7-ethoxylate[1] or $C_{12}$-$C_{14}$ alkyl 7-ethoxylate[3] (or mixtures thereof) | 14.5 | 14.5 | 13.6 | 14.5 | 14.5 |
| $C_{12}$-$C_{18}$ Fatty Acid[4] | 6.1 | — | 11.0 | — | — |
| Ratio of anionic surfactant:non-ionic surfactant | 2.3:1 | 1.9:1 | 2.6:1 | 1.9:1 | 2.3:1 |
| 1,2 Propane diol[5] | 15.0 | 15.7 | 15.7 | 15.7 | 15.7 |
| Glycerol | 5.0 | 4.9 | 4.9 | 4.9 | 4.9 |
| Di propylene Glycol | 0.07 | 0.07 | 0.07 | 0.07 | 0.07 |
| Citric acid | 0.7 | 0.7 | 0.7 | 0.7 | 0.7 |
| Enzymes (mixtures of Protease[6] and (amylase, lipase, mannanase, xyloglucanase)[7] | 0.1 | 0.05 | 0.05 | 0.05 | 0.05 |
| Fluorescent Whitening Agent[8] | 0.3 | 0.3 | 0.3 | 0.3 | 0.3 |
| Hueing Agent | 0.03 | 0.0 | 0.0 | 0.0 | 0.0 |
| Hydroxy Ethylidene 1,1 Di Phosphonic acid | 2.1 | 0.8 | 0.8 | 0.8 | 0.8 |
| Cleaning Polymers[10, 11, 12] | 6.9 | 3.2 | 3.2 | 3.2 | 3.2 |
| Hydrogenated castor oil[13] | 0.13 | 0.15 | 0.15 | 0.15 | 0.15 |
| Cationic Polymer | 0.40[14] | 0.40[14] | 0.40[15] | 0.40[15] | 0.40[15] |
| Perfume microcapsule[16] | — | 0.63 | 0.63 | 0.63 | 0.63 |
| Organosiloxane polymer[17] | 6.0 | 4.0 | 4.0 | 6.0 | 6.0 |
| Water, perfumes, dyes, buffers, neutralizers, stabilizers and other optional components | to 100% pH 7.0-8.5 | to 100% pH 7.0-8.5 | to 100% pH 7.0-8.5 | to 100% pH 7.0-8.5 | to 100% pH 7.0-8.5 |

Ingredient Key for Tables 1, 2, and 3

[1] Available from Shell Chemicals, Houston, Tex.

[2] Available from Huntsman Chemicals, Salt Lake City, Utah

[3] Available from Sasol Chemicals, Johannesburg, South Africa

[4] Available from The Procter & Gamble Company, Cincinnati, Ohio

[5] Available from Sigma Aldrich chemicals, Milwaukee, Wis.

[6] Available from DuPont-Genencor, Palo Alto, Calif.

[7] Available from Novozymes, Copenhagen, Denmark

[8] Available from Ciba Specialty Chemicals, High Point, N.C.

[9] Available from Milliken Chemical, Spartanburg, S.C.

[10] 600 g/mol molecular weight polyethylenimine core with 20 ethoxylate groups per —NH and obtained from BASF (Ludwigshafen, Germany)

[11] 600 g/mol molecular weight polyethylenimine core with 24 ethoxylate groups per —NH and 16 propoxylate groups per —NH. Obtained from BASF (Ludwigshafen, Germany)

[12] Described in WO 01/05874 and obtained from BASF (Ludwigshafen, Germany)

[13] Available under the tradename ThixinR from Elementis Specialties, Highstown, N.J.

[14] Copolymer of a mol ratio of 88% acrylamide and 12% methacrylamido propyl trimethylammonium chloride with a weight-average molecular weight of 1500 kDa, obtained from Nalco Chemicals, Naperville, Ill.

[15] Terpolymer of a mol ratio of 90% acrylamide and 5% methacrylamido propyl trimethylammonium chloride and 5% acrylic acid with a weight-average molecular weight of 1800 kDa as reported by supplier, obtained from Nalco Chemicals, Naperville, Ill.

[16] Available from Appleton Paper of Appleton, Wis.

[17] Magnasoft Plus, available from Momentive Performance Materials, Waterford, N.Y.

[18] Silicone polyether from Dow-Corning, Midland, Mich.

[19] PDMS, DC349, available from Dow-Corning, Midland, Mich.

[20] PDMS, s 1000 cSt, available from Gelest, Morrisville, Pa.

Example 4. Silicone Deposition and Surfactant Ratio Selection

Examples 4A-4C demonstrate the effect of anionic:nonionic surfactant ratio selection on silicone deposition on different fabrics in a multi-cycle test in a North American top loading automatic washing machine, according to the Silicone Deposition Test Method given above. The fabrics were treated with detergents according to Formulas 1G, 1E, and 1F, respectively, as indicated below in Table 4.

TABLE 4

| Example | Formula | Anionic:Non-Ionic surfactant ratio | Silicone Deposition (ug/g) 100% Cotton Fabric | Silicone Deposition (ug/g) 50/50 Polyester Cotton Fabric |
|---|---|---|---|---|
| 4A (comp) | 1G | 25:1 | 40 | 60 |
| 4B | 1E | 1.7:1 | 140 | 160 |
| 4C | 1F | 1.7:1 | 180 | 880 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising a cationic polymer, a silicone, and a surfactant system, wherein said cationic polymer is characterized by having a calculated cationic charge density of equal to or greater than about 1 meq/g, wherein said cationic polymer is further characterized by a molecular weight of from about 800 kDaltons to about 2000 kDaltons, wherein said cationic polymer is acrylamide/MAPTAC, wherein said cationic polymer is substantially free of any silicone-derived structural unit;

wherein said surfactant system comprises anionic surfactant and nonionic surfactant in a weight ratio of from about 1.5:1 to about 2.5:1, said anionic surfactant comprises linear alkyl benzene sulfate (LAS) and alkyl ether sulfate (AES), wherein said LAS and said AES are present in a weight ratio of from about 0.5:1 to about 2:1, and wherein the nonionic surfactant comprises one or more ethoxylated alcohols;

wherein said detergent composition further comprises an adjunct selected from the group consisting of microencapsulates, enzymes, a soil release polymer, a hueing agent, and combinations thereof.

2. A detergent composition according to claim 1, wherein said cationic polymer is characterized by having a cationic charge density of from about 1.2 meq/g to about 8 meq/g.

3. A detergent composition according to claim 1, wherein said cationic polymer is characterized by having a calculated cationic charge density of from about 1.5 meq/g to about 5 meq/g.

4. A detergent composition according to claim 1, wherein said cationic polymer comprises from about 5 mol % to about 98 mol % of a nonionic structural unit.

5. A detergent composition according to claim 4, wherein said cationic polymer comprises from about 10 mol % to about 95 mol % of said nonionic structural unit.

6. A detergent composition according to claim 1, wherein said cationic polymer comprises from about 2 mol % to about 100% of a cationic structural unit.

7. A detergent composition according to claim 6, wherein said cationic polymer comprises from about 5 mol % to about 95 mol % of said cationic structural unit.

8. A detergent composition according to claim 1, wherein said silicone is an aminosilicone.

9. A detergent composition according to claim 1, wherein said silicone is a polydimethylsiloxane.

10. A detergent composition according to claim 1, wherein said silicone is present as a nanoemulsion, wherein said nanoemulsion is characterized by a mean particle size of from about 10 nm to about 500 nm.

11. A detergent composition according to claim 1, wherein said detergent composition further comprises from about 0.1% to about 6%, by weight of the composition, of fatty acid and/or a salt thereof.

12. A detergent composition according to claim 1, wherein said detergent composition further comprises an external structuring system comprising non-polymeric crystalline hydroxy-functional structurants, polymeric structurants, or mixtures thereof.

13. A detergent composition according to claim 1, wherein said detergent composition is a liquid.

14. A detergent composition according to claim 1, wherein said detergent composition is encapsulated in a pouch, wherein said pouch comprises water-soluble film.

15. A method of treating a fabric, comprising the step of contacting said fabric with said detergent composition of claim 1.

* * * * *